US006502482B1

(12) United States Patent
Putsch et al.

(10) Patent No.: US 6,502,482 B1
(45) Date of Patent: Jan. 7, 2003

(54) ONE-HAND ACTUATED, SELF-CLOSING PLIERS

(76) Inventors: Ralf Putsch, Hastener Strasse 140, Wuppertal, D-42349 Wuppertal (DE); Karl Putsch, Rennbaumer Strasse 70, Wuppertal, D-42349 Wuppertal (DE)

( * ) Notice: Subject to any disclaimer, the term of this patent is extended or adjusted under 35 U.S.C. 154(b) by 0 days.

(21) Appl. No.: 09/786,670

(22) PCT Filed: Sep. 7, 1999

(86) PCT No.: PCT/EP99/06560

§ 371 (c)(1),
(2), (4) Date: Jun. 4, 2001

(87) PCT Pub. No.: WO00/13856

PCT Pub. Date: Mar. 16, 2000

(30) Foreign Application Priority Data

Sep. 7, 1998 (DE) ..... 198 40 741
Aug. 26, 1999 (DE) ..... 199 40 485

(51) Int. Cl.[7] ..... B25B 7/04
(52) U.S. Cl. ..... 81/405; 81/358; 81/413
(58) Field of Search ..... 81/405, 355, 358, 81/359, 407, 409, 409.5, 411, 413, 417, 427, 427.5

(56) References Cited

U.S. PATENT DOCUMENTS

| | | | | |
|---|---|---|---|---|
| 1,048,298 A | * | 12/1912 | Daniels | 81/340 |
| 2,531,285 A | * | 11/1950 | Manspeaker | 81/344 |
| 2,906,155 A | | 9/1959 | Miller | |
| 3,176,551 A | * | 4/1965 | Hansen | 81/341 |
| 4,651,598 A | | 3/1987 | Warheit | |
| 4,893,530 A | | 1/1990 | Warheit | |
| 5,850,768 A | * | 12/1998 | Chow | 81/413 |
| 5,887,495 A | * | 3/1999 | Kao | 81/358 |
| 5,970,827 A | * | 10/1999 | Lin | 81/409 |
| 6,000,303 A | * | 12/1999 | Chang | 81/341 |
| 6,101,908 A | * | 8/2000 | Azkona | 81/358 |
| 6,116,124 A | * | 9/2000 | Ping | 81/385 |
| 6,155,142 A | * | 12/2000 | Bally et al. | 81/389 |
| 6,161,455 A | * | 12/2000 | Ping | 81/358 |
| 6,199,459 B1 | * | 3/2001 | Azkona | 81/413 |

FOREIGN PATENT DOCUMENTS

| | | |
|---|---|---|
| DE | 2031661 | 1/1971 |
| DE | 29803998 | 5/1998 |
| DE | 29907864 | 7/1999 |
| EP | 0854011 | 7/1998 |

* cited by examiner

*Primary Examiner*—James G. Smith
*Assistant Examiner*—Hadi Shakeri
(74) *Attorney, Agent, or Firm*—Martin A. Farber

(57) ABSTRACT

The spring mechanism (12) of a one-hand actuated pliers consists of a spring (14) supported on both handles (2, 3), which is designed in such a way that the handles (2, 3) are separated at a distance from each other by rotating the handle (3) and wherein the movable handle (3) of the pliers can be moved by the spring to the widest open position of the jaws by rotating said handle (3), wherein a rotation support of the spring (14) is configured on one side of the handle (2) and the spring (14) rests on said side against a rotational stop (19) formed on the handle (2) when it is not actuated. When the movable handle (3) of the pliers is displaced to a closing position of the jaws in which a workpiece is gasped, the spring (14) is released from the rotational stop only if force is exerted when the cheeks of the jaws (5, 6) are grasping the workpiece.

51 Claims, 19 Drawing Sheets

-M-
5
11
6
9
4
F
1
2
15
17
16
b
a
a
3
24
14
12
13
7
8

11
9
10
2
4

5
-M-
6
11
9
4
F
1
3
2
17
15
17
b
19
a
16
8
7

-M-
5
6
9
11
4
F
1
2
28
19
17
15
16
b
3
a
12
13
14
7
8

-M-
5
6
9
11
4
F
1
37
2
35
38
33'
15''
15'
3
B
36
16'
14
33
33''
34
12
7
8
39'
39

ONE-HAND ACTUATED, SELF-CLOSING PLIERS

FIELD AND BACKGROUND OF THE INVENTION

The invention relates to a self-closing pliers which can be actuated by one hand, having two pliers legs which are connected to one another by means of an articulation bolt, it being the case that a pliers mouth is formed above the crossover region of the pliers legs and handle sections are formed on the pliers legs below the crossover region, it being the case that one of the pliers legs, which can be adjusted relative to the other pliers leg in the crossover region in order to change the size of the pliers mouth, has a free space which is penetrated by the other pliers leg, or the non-adjustable pliers leg is penetrated by the adjustable pliers leg, and it being the case that, furthermore, the pliers legs are connected via a regulating element and a spring drive, which biasses the pliers mouth into an open position, which open position is produced automatically under spring loading once the handle sections have been relieved of loading, it being the case that, moreover, in a first movement section of the spring drive, the pliers-mouth jaws move towards one another and, in a second movement section, a catch of the articulation bolt engages in a latching toothing formation, whereupon forced rotation of the movable pliers-mouth jaw about the articulation bolt can be carried out.

SUMMARY OF THE INVENTION

It is an object of the invention to improve pliers of the generic type in structural and functional terms.

This object is achieved first and foremost, in the case of such pliers having the features of claim 1, this being based on the fact that the spring drive comprises a spring which is supported on the two pliers legs and is formed so as to effect both expansion of the pliers legs into a spaced-apart position and displacement of the movable pliers leg into the largest opening position of the mouth, with rotation of the pliers leg by said spring, it being the case that a rotary support of the spring is formed on the pliers leg on at least one side and on this side, in the non-actuated state, the spring butts against a rotary stop formed on the pliers leg, it being the case that, upon displacement of the movable pliers leg into a workpiece-gripping closed position of the mouth, the spring is released from the rotary stop only with the actuation of force when the pliers-mouth jaws are butting against the workpiece. This gives a self-contained force system integrated in a regulating element. The spring is prestressed such that, when the pliers are released, the movable pliers leg snaps into the open position. It is advantageous then for the regulating element to be formed by a spring which is supported on the two pliers legs and, at the same time, biasses the pliers mouth into the open position. The rotary stop is formed as a supporting flank. This can also easily be taken into account in terms of moulding technology. It is further proposed that the leg spring has two spring sections of different stiffnesses. This results in an operational sequence of the spring drive. The invention also proposes that the different stiffnesses are achieved by different lengths of the spring sections. It is further provided that the spring is subdivided into the two spring sections by means of a spring coil. Such a spring coil, which may be formed with a plurality of layers, contains an adapted stored spring-force reserve. It is further provided that the points of articulation of the spring are disposed at different spacings from the pliers mouth. In specific terms, this takes place such that the point of articulation of the longer spring section is closer to the pliers mouth. In addition, one configuration is implemented to the effect that the shorter spring section is supported at a location beyond which it is not possible to pass in the direction of the pliers mouth. Precautions are taken here for a capacity for rotary movement of the shorter spring section at the point of articulation to be limited in angular terms. It is provided here that the angle of rotation is an acute angle. It is further provided that the spring has two coils located one beside the other. This gives an even more balanced force system, in particular a good spring characteristic.

In the case of pliers having the features of the preamble of claim 1, it is advantageous for the regulating element to be made up of a spring section and a rigid section. Like the short spring section, this rigid section is also supported at a location beyond which it is not possible to pass in the direction of the pliers mouth. In the case of this solution, it is also proposed that the spring section is formed by a helical spring. This may be a leaf spring with an end turn which encloses a central non-round cross-section in a slip-free manner. It is advantageous here for the rigid section to be a link, at one end of which the spring element is fastened in the manner described and the other end of which is disposed rotatably on the pliers leg, in this case too, in turn, with the proviso of being supported at a location beyond which it is not possible to pass.

It is advantageous in terms of stability if the link is formed in a pair and a free space for the spring and the spring fastening is left by virtue of the two links being spaced apart. It is advantageous here for the spring fastening to be achieved by a carrying pin which penetrates the group of turns of the spring coil and connects the links. The spring is thus secured reliably. It is favourable here, moreover, for the spring section of the spring in the form of a rotary leg spring, said spring section being directed towards the rigid section, to be supported on the rigid section. The support may be formed by a tongue cut out of the link; alternatively, the support may be formed by a pin which likewise connects the links. It is then proposed that the spring is supported on two rigid sections which are connected to one another in the manner of a toggle lever. In order to assist the biassing force of the spring, it may further be proceeded such that a second spring which is disposed on the handle section preloads one of the rigid sections in order to produce a straightened-out position of the rigid sections in relation to one another. As regards the abovementioned straightened-out position, it may be said that, in the straightened-out state, the two rigid sections enclose between them an angle of less than 180° which opens on the mouth side. This prevents a dead-centre position of the rigid sections, which are connected to one another in the manner of a toggle joint, between the points of articulation of the pliers legs. A further feature is that the rigid section connected to the further spring is double-armed. The spring action thus takes place in the same direction as the other, first spring.

Pliers with a minimum number of components are achieved if the spring is formed as a clip spring with clip-spring arms and a clip-spring bend, the clip-spring arms being supported on one of the pliers legs and the clip-spring bend being supported on another of the pliers legs. The spring and regulating elements are configured integrally with one another. The clip-spring arms or the clip-spring bend are/is supported by means of a rigid section mounted rotatably on a pliers leg. The spring prestressing of the spring drive and the spring force itself are applied here in that the freely projecting clip-spring arms are supported rotatably on a rigid section or a pliers leg via different axes of rotation. The spacing between the axes of rotation is converted into the desired spring force by the pliers legs being pivoted. The clip-spring arms are formed to be of different lengths. This, in conjunction with the spaced-apart axes of rotation, results in a torsional action in the clip-spring bend and also in a specific curvature of the clip-spring arms. The clip-spring arms may be curved, for example in the manner of an already slight precurvature. The curvature is formed to be concave in the direction facing the pliers mouth. It is also proposed that formed on the rigid section is a stop which interacts with the spring when the spring drive is in the straightened-out position. In addition, it may be advantageous for the clip-spring bend to be of helical form. This makes it possible to achieve a bearing eyelet at the same time. The bearing eyelet is not made to undergo a torsional action. Moreover, it is provided that the clip-spring bend is supported in a longitudinally movable manner on a pliers leg. A straightforward association is achieved here in that the clip-spring bend is accommodated in a slot of a pliers leg. In order for it to be possible to maintain, by straightforward means, the sequence of the mouth being closed and applying a forceful grip, it is proposed that the support of the clip-spring bend is of profiled form with an initial supporting surface which is inclined in relation to the longitudinal direction of the pliers leg and grips below the clip-spring bend. An alternative feature consists in that a tension spring acting in the longitudinal pliers-leg direction acts on the clip-spring bend.

BRIEF DESCRIPTION OF THE DRAWINGS

The subject matter of the invention is explained hereinbelow with reference to exemplary embodiments illustrated in the drawing, in which.

DETAILED DESCRIPTION OF THE PREFERRED EMBODIMENTS

The pliers 1 of all the exemplary embodiments have two pliers legs 2 and 3 crossing over one another. In the crossover region, these pliers legs are connected in an articulated manner in relation to one another via an articulation bolt 4.

A pliers mouth M is located above said crossover region of the pliers legs 2, 3. Below the crossover region, defined by the articulation bolt 4, the pliers legs 2, 3 merge into elongate handle sections 7, 8.

Figure 1:
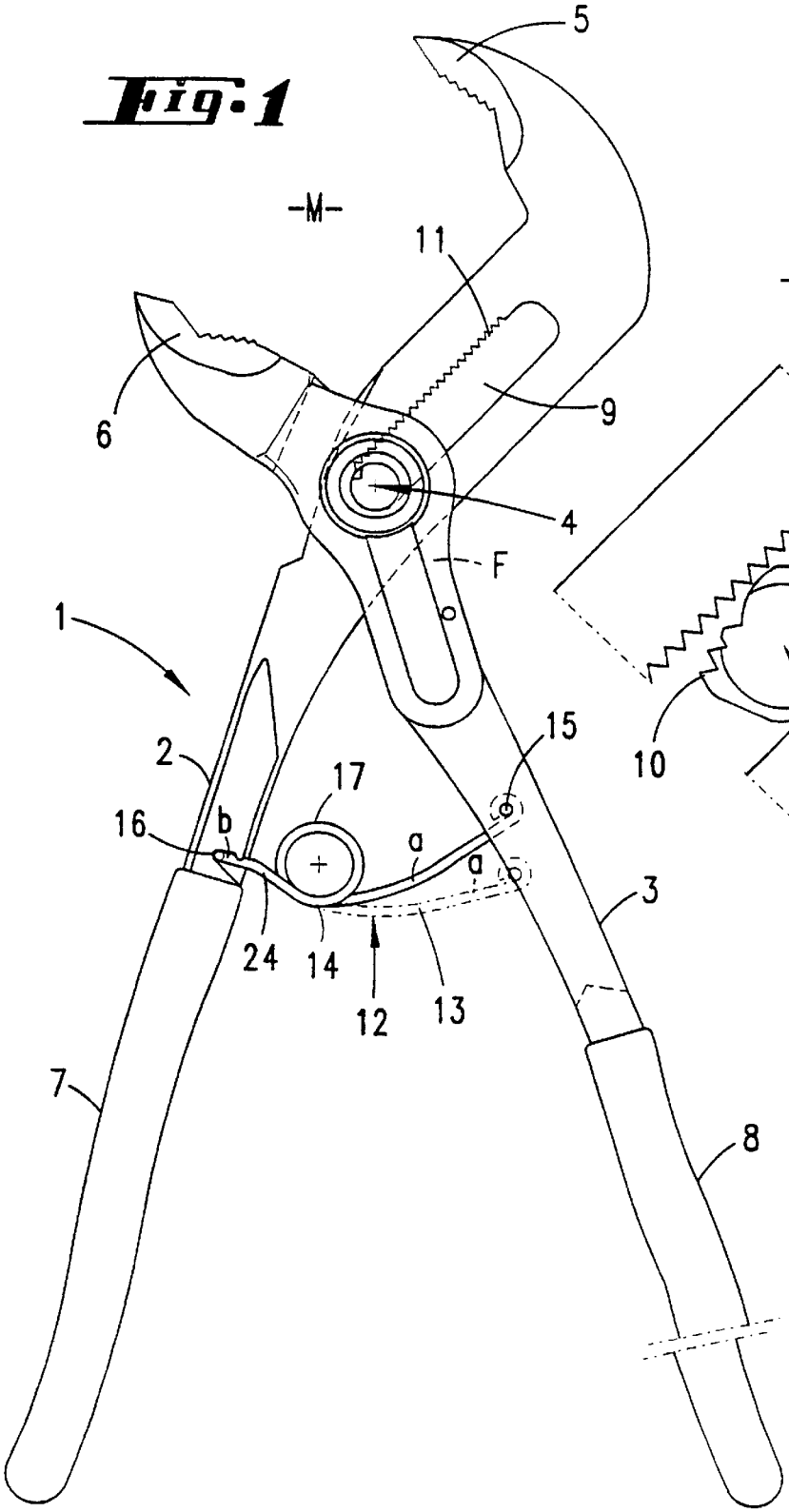
FIG. 1 shows a first exemplary embodiment of the pliers in side view, in a spring-loaded, basic position.
Figure 2:
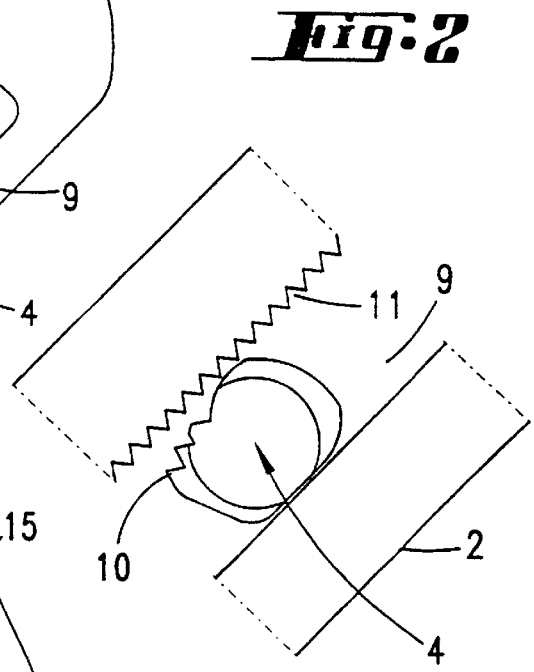
FIG. 2 shows an enlargement of FIG. 1, illustrating the position of the articulation bolt.
Figure 4:
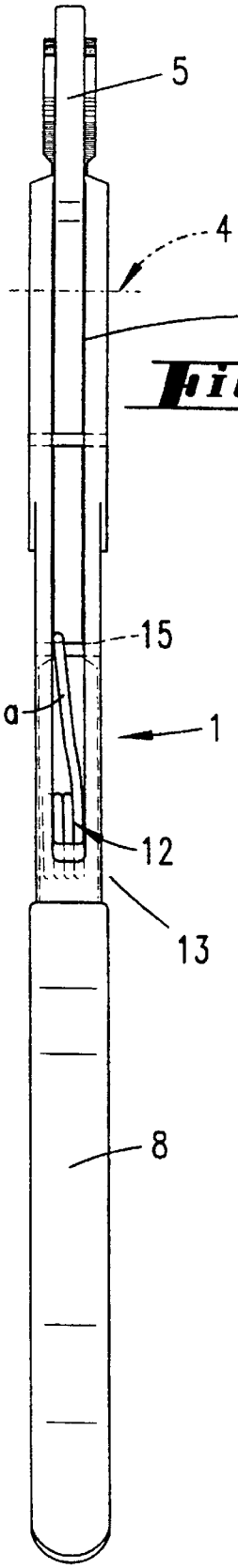
FIG. 4 shows the rear view of the pliers.
Figures 5, 6:
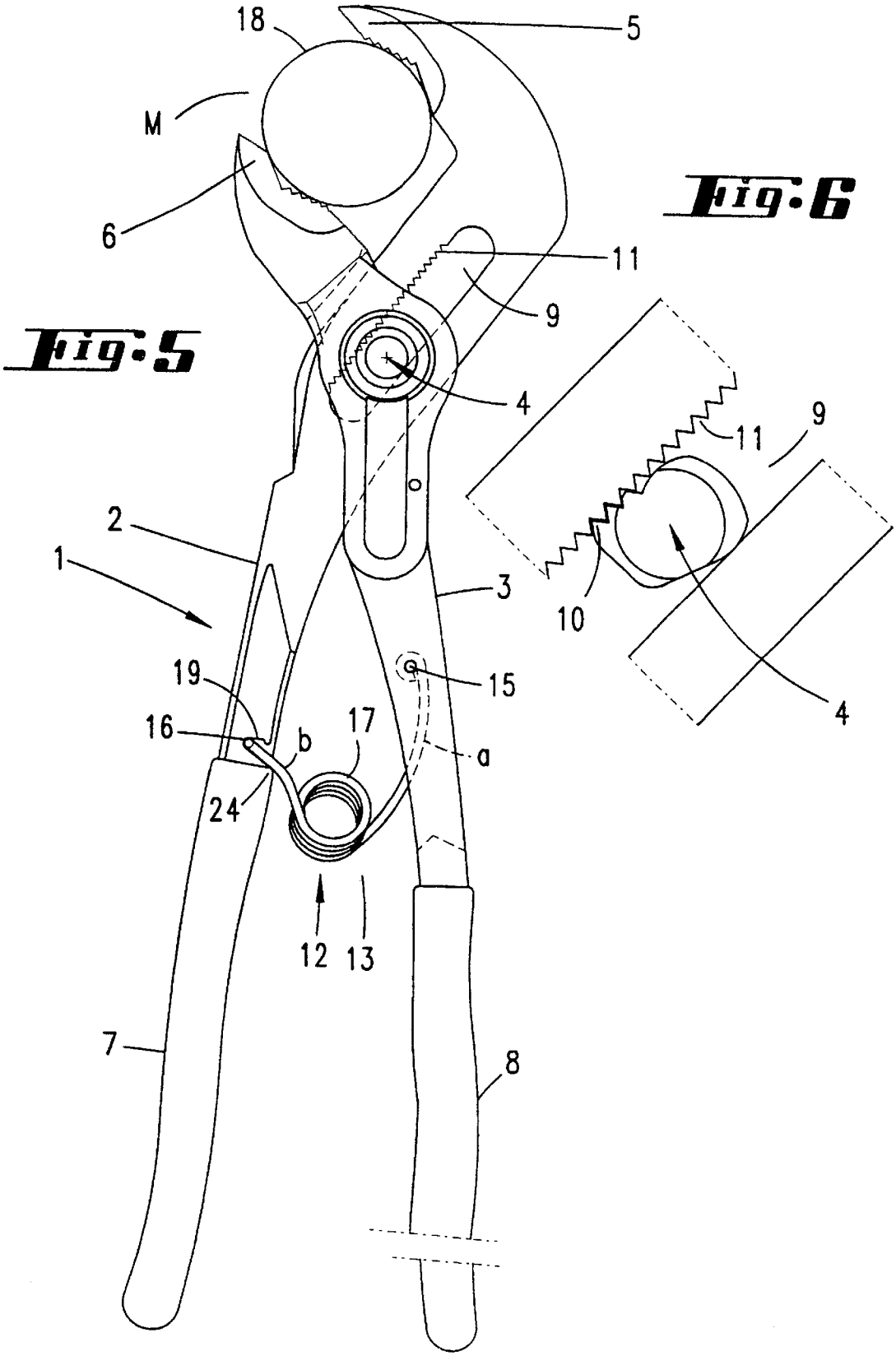
FIG. 5 shows a side view of the pliers gripping an object.
FIG. 6 shows an enlargement showing the position then assumed by the articulation bolt.
Figure 8:
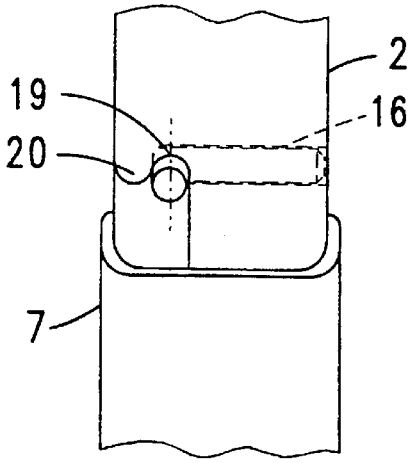
FIG. 8 shows the section along line VIII—VIII in FIG. 7.

The articulation bolt 4 penetrates a longitudinal slot 9 of the pliers leg 2. The articulation bolt 4 is mounted in the penetrated pliers leg 3. The articulation bolt 4 carries a catch 10. This interacts with tooth gaps 11 of a mouth-side tooth profiling of the penetrating pliers leg 2. FIG. 2 shows the disengagement position in FIG. 1, and FIG. 6 shows the engagement position of this latching toothing formation which is assumed in FIG. 5. The longitudinal slot 9 and tooth gaps 11 may be formed on the penetrated pliers leg 3 rather than on the penetrating pliers leg. In this case, the penetrated pliers leg 3 corresponds geometrically to the pliers leg 2 in the attached drawing, the only difference being that this pliers leg then has two slots spaced apart transversely to the longitudinal pliers plane and provided with tooth gaps 11. The penetrating pliers leg, otherwise formed, in geometrical terms, in accordance with the pliers leg 2 according to the attached drawing, is accommodated in the vertical spacing between the slots.

In order to change the size of the pliers mouth M, the corresponding insertion connection has an appropriate free space F. This is located in the penetrated pliers leg 3.

A spring drive 12 keeps the pliers 1 in a basic position, in which the mouth is open (see FIGS. 1, 11, 17, 18, 19, 20, 22, 24, 26). For this purpose, the spring drive 12, which is accommodated in the interspace of the pliers legs 2, 3, acts so as to expand the pliers legs. The end position is defined by striking against the lower end of the longitudinal slot 9.

Figure 3:
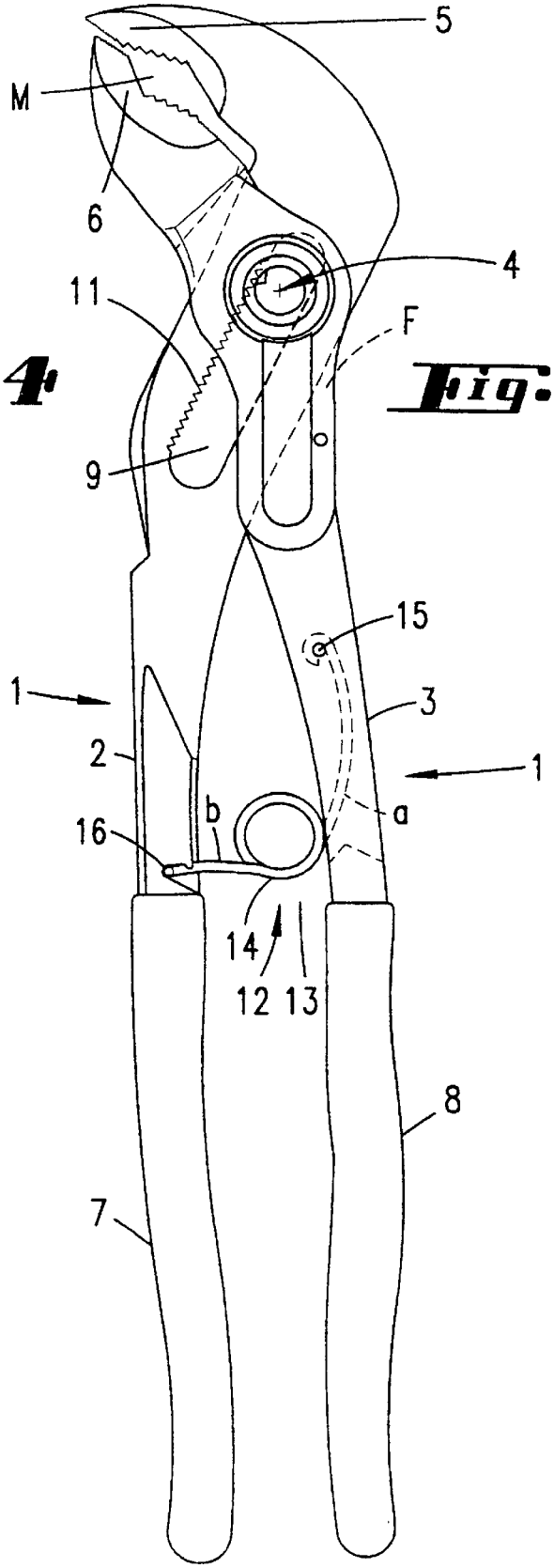
FIG. 3 shows the pliers in side view, in the closed state.

The spring drive 12 has prestressing, depicted as a chain-dotted position in FIG. 1. To this extent, the open position is biassed effectively but such that it can be overcome. With closure of the expanded pliers legs 2, 3, the pliers jaw 6 of the displaceably and pivotably mounted pliers leg 3 moves in the direction of the pliers jaw 5 of the penetrating pliers leg 2. This can be seen from FIG. 3. Accordingly, the open position according to FIG. 1 is obviously achieved fully automatically by the abovedescribed spring loading once the handle sections 7, 8 of the pliers legs 2, 3 have been relieved of loading.

The spring drive 12, which passes through or bridges over the intervening region between the pliers legs 2, 3, performs the function of a regulating element 13 at the same time. This element, supported by the penetrating pliers leg 2, projects freely on the intervening region side. It forms a type of extension arm, it being the case that, in a first movement section of the spring drive 12, the pliers-mouth jaws 5, 6 move towards one another and, in a second movement section, the catch 10 of the articulation bolt 4 engages in the latching toothing formation 11. Accordingly, forced rotation of the movable, that is to say penetrated pliers leg 3, or of the pliers-mouth jaw 6 of the same, about the articulation bolt 4 can be carried out. Coinciding movements take place here.

In the first exemplary embodiments, the unit comprising spring drive/regulating element 12/13 forms a spring 14, more precisely a leg spring.

The spring 14 has its ends articulated on one of the pliers legs 2, 3 in each case. The point of articulation on the penetrated pliers leg 3 is designated 15. It is a rotary point of articulation. The point of articulation realized on the penetrating pliers leg 2 is designated 16. The geometrical axes of the points of articulation 15, 16 are spatially parallel to the geometrical axis of the articulation bolt 4.

The spring 14 or leg spring has two spring sections of differently effective stiffnesses. The one spring section a is more resilient. The other spring section is designated b. Its resilience may even approach zero. This spring section b is associated with the pliers leg 2.

Figure 11:
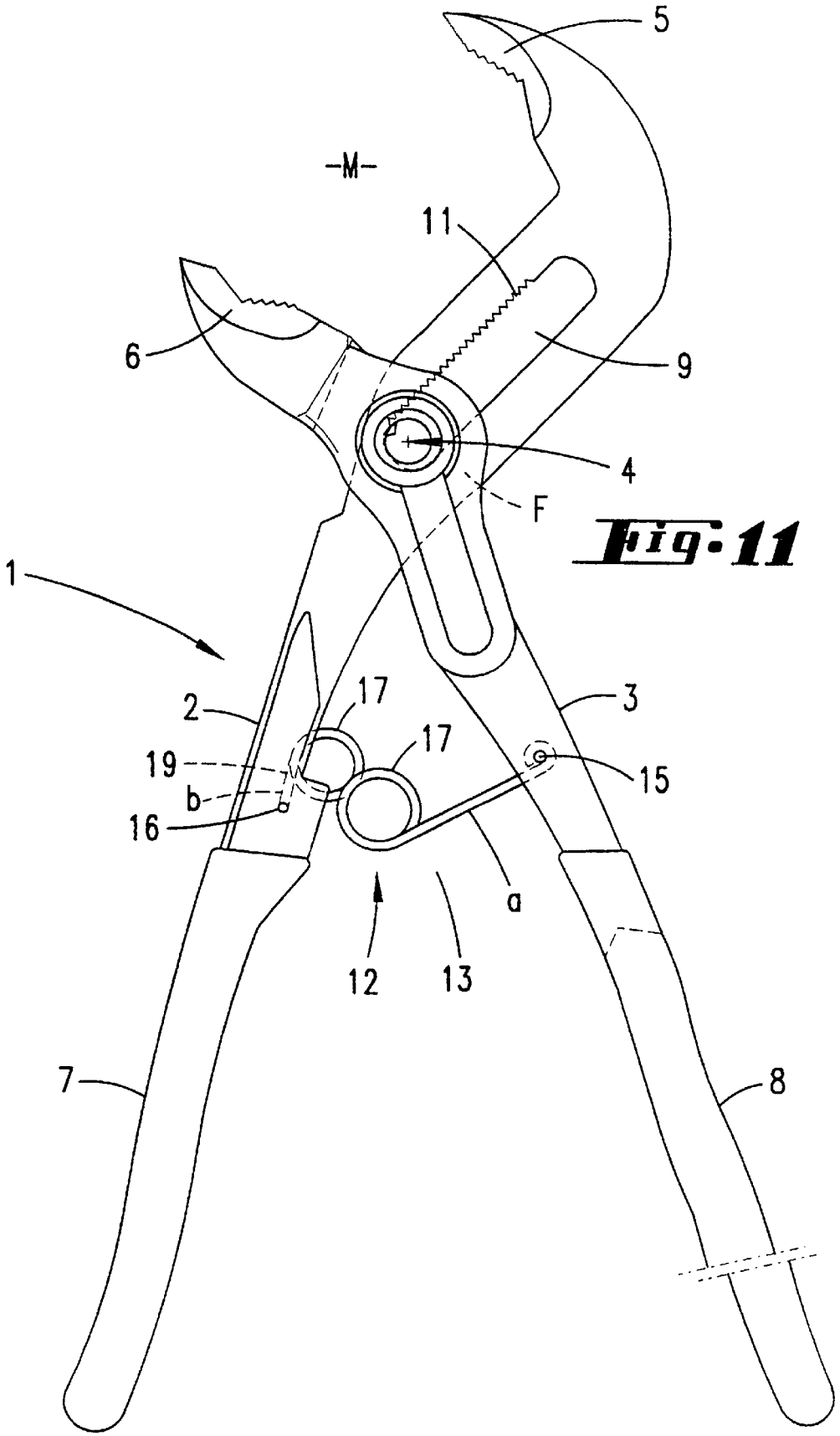
FIG. 11 shows a second exemplary embodiment of the pliers in side view, in a spring-loaded, open position.
Figure 12:
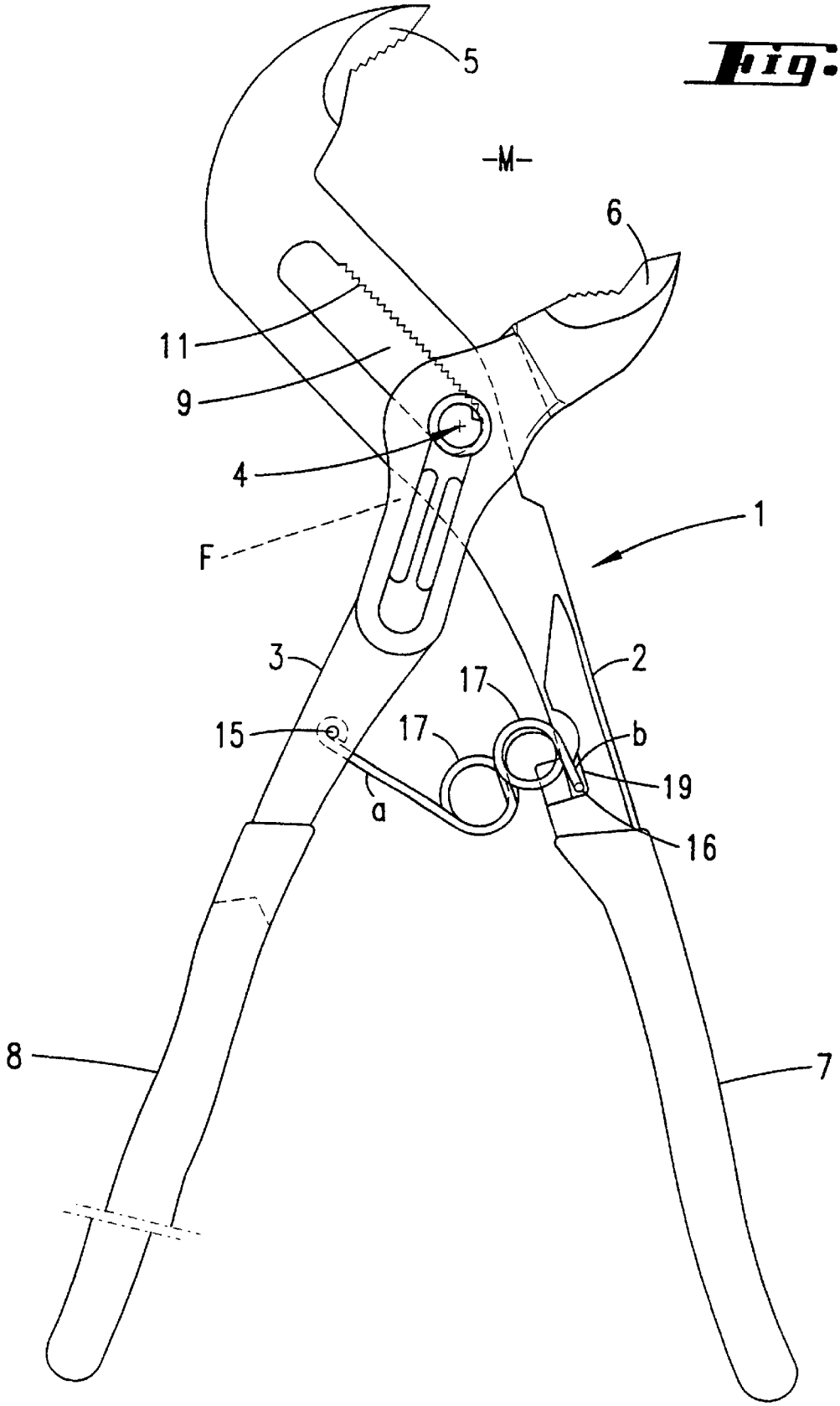
FIG. 12 shows the other side of the pliers in a position according to FIG. 11.
Figure 13:
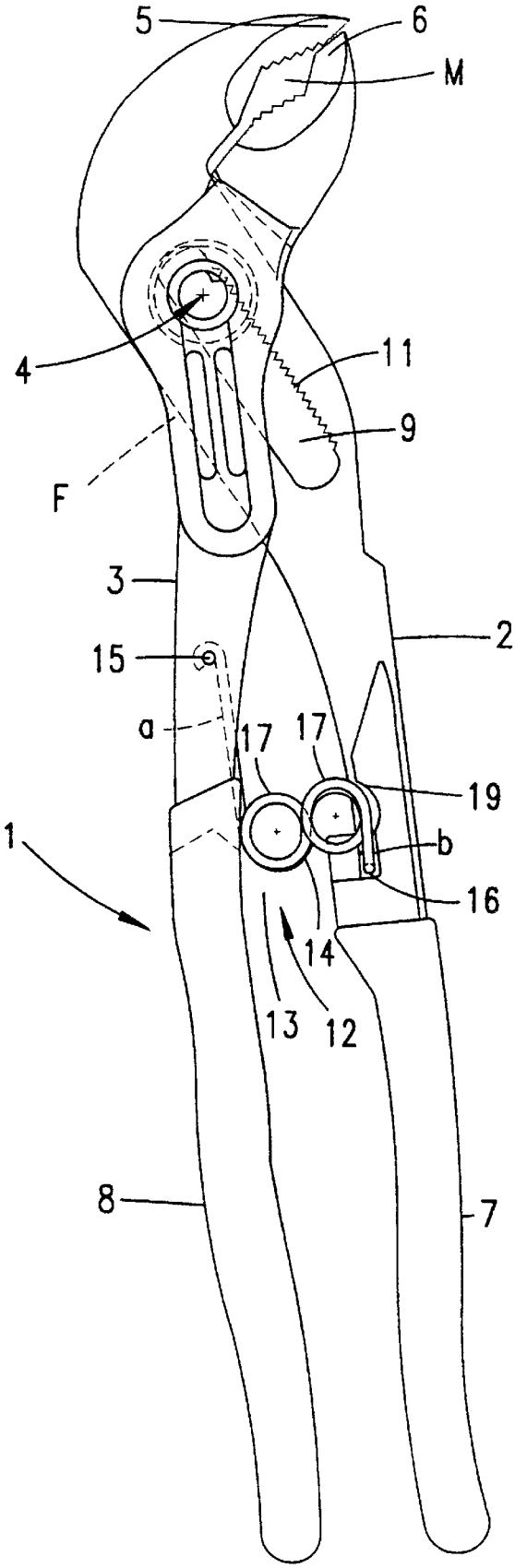
FIG. 13 shows these pliers in the closed state.
Figure 14:
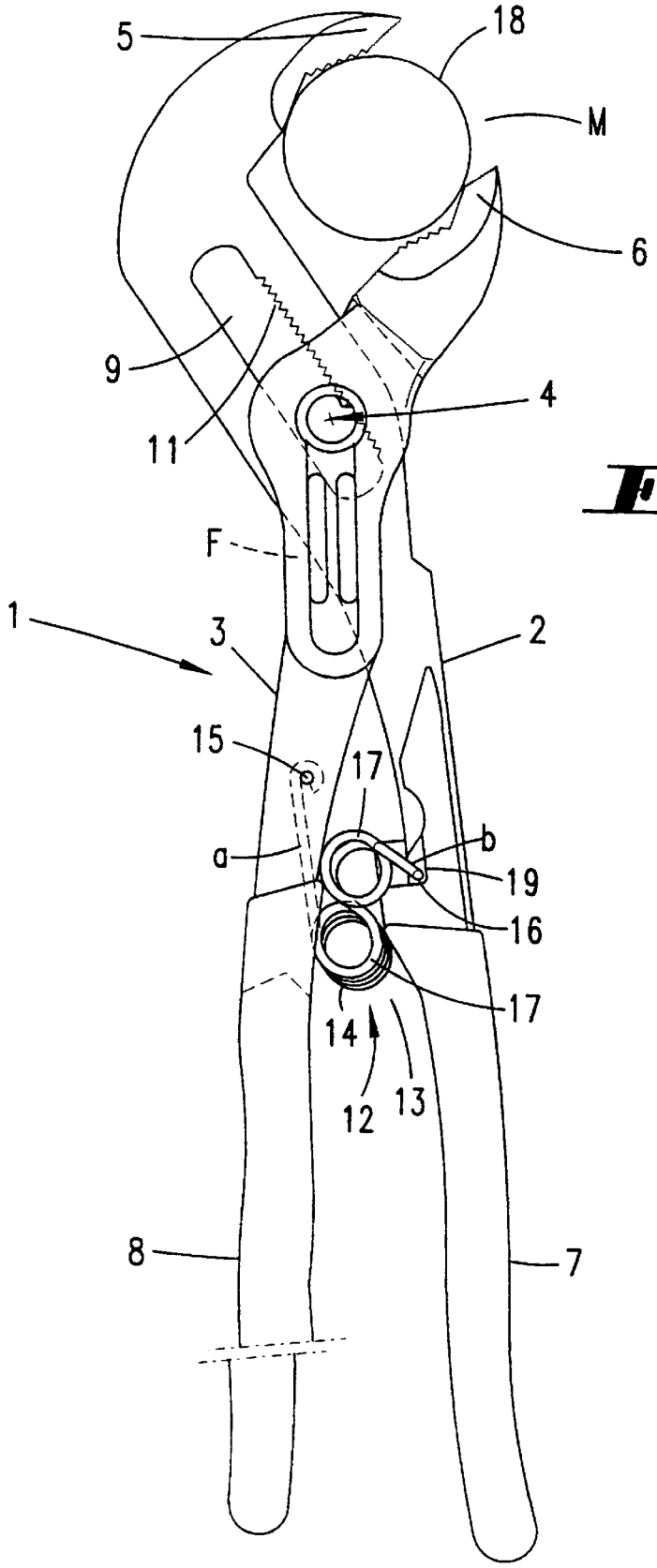
FIG. 14 shows the pliers gripping an object.
Figure 15:
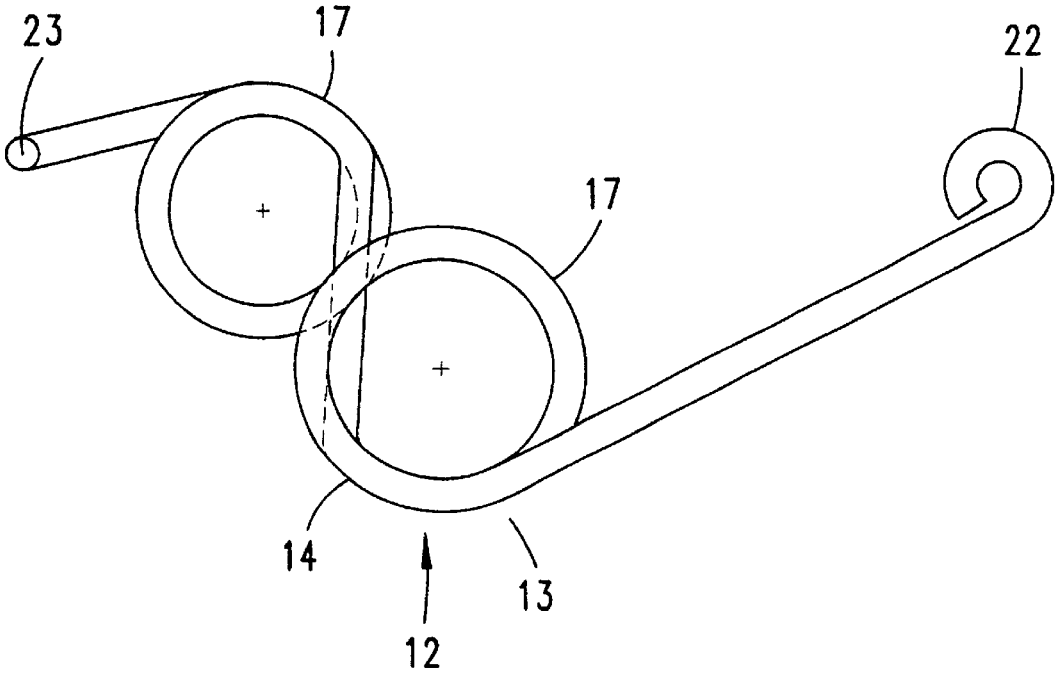
FIG. 15 shows the spring of these pliers in side view.
Figure 16:
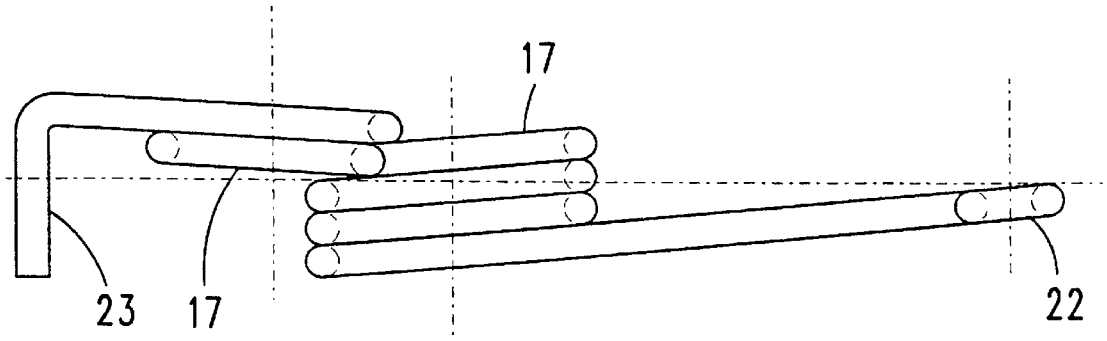
FIG. 16 shows a plan view thereof.
Figure 17:
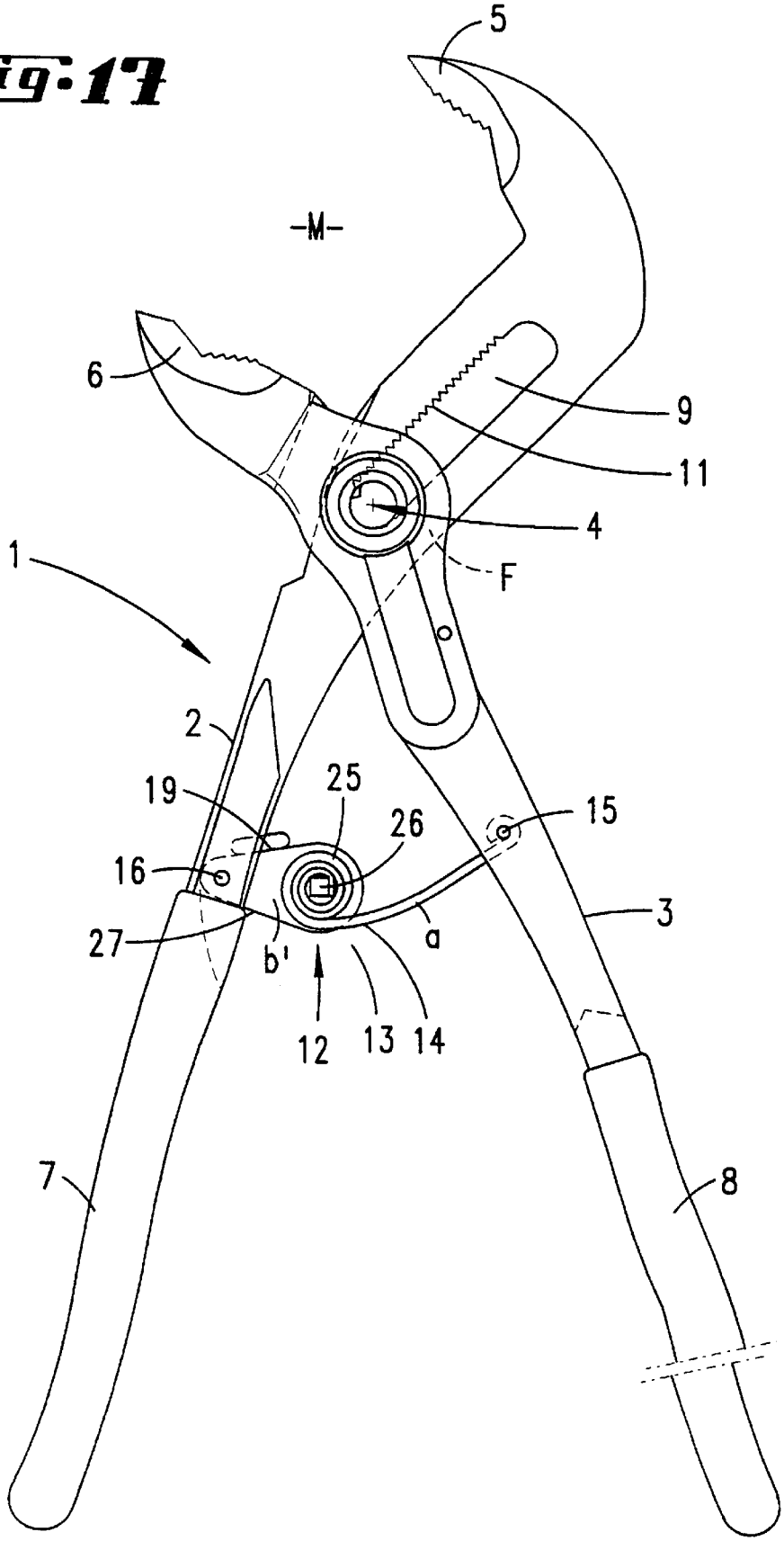
FIG. 17 shows a third exemplary embodiment of the pliers in side view, in a spring-loaded, open position.
Figure 18:
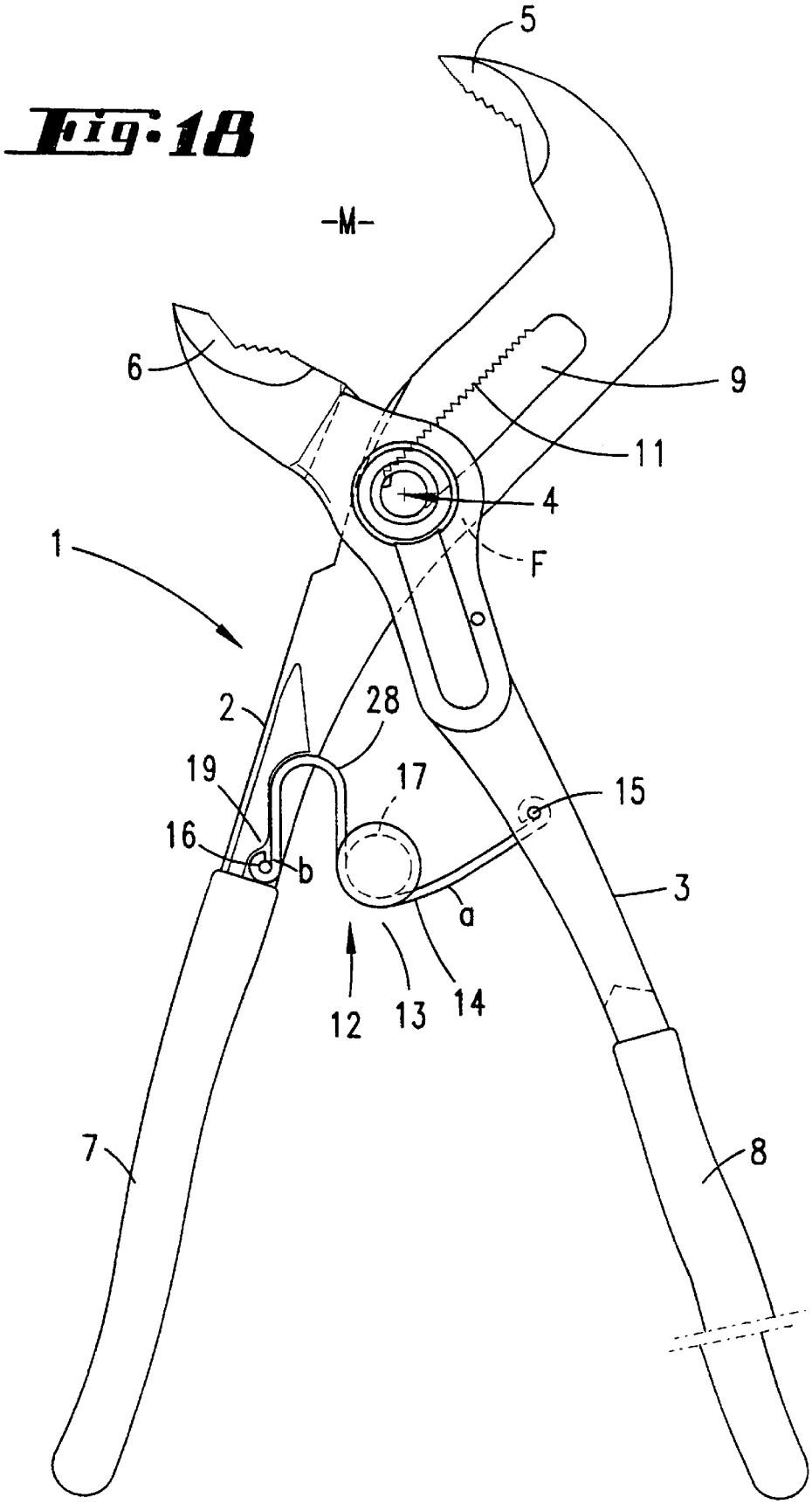
FIG. 18 shows a fourth exemplary embodiment of the pliers in side view, in a spring-loaded, open position.

The different resiliences are based on different lengths of the spring sections a, b made of wire, irrespective of whether one of the spring sections also includes a (further) coil 17 such as, for example, the exemplary embodiment of FIG. 11.

The two spring sections a, b, running in a more straightened-out or curved manner, extend from a common spring coil 17. This is located on that side of the spring 14 which is directed towards the articulation bolt 4.

The points of articulation 15, 16 of the spring are disposed at different spacings from the pliers mouth M. The point of articulation 15 of the longer spring section a is thus closer to the pliers mouth M. The closeness becomes even more pronounced when the pliers 1 are closed or an object is gripped. The corresponding object, e.g. a tube, is designated 18 (see, for example, FIG. 5). The spring deflection of the leg spring takes place, in respect of the spring coil 17, on the handle-section side.

The points of articulation 15, 16 and the end-supported position of the articulation bolt 4 form an inherently stable articulation triangle, effected by the restoring force of the prestressed spring 14. In this arrangement, in other words in the basic position, the shorter spring section b is supported on the handle-leg side. The supporting flank, as rotary stop, is designated 19. It is located such that the shorter spring section b can only pivot about its point of articulation 16 in the direction away from the articulation bolt. Also extending from the supporting surface 19 is a nose 20 which secures that end section of the shorter spring section b which is in the vicinity of the articulation. The capacity for rotary movement of the shorter spring section 9, moreover, is limited in angular terms. This is a free, acute-angled movement range. The acute angle encloses approximately 30° to 40°.

Figure 7:
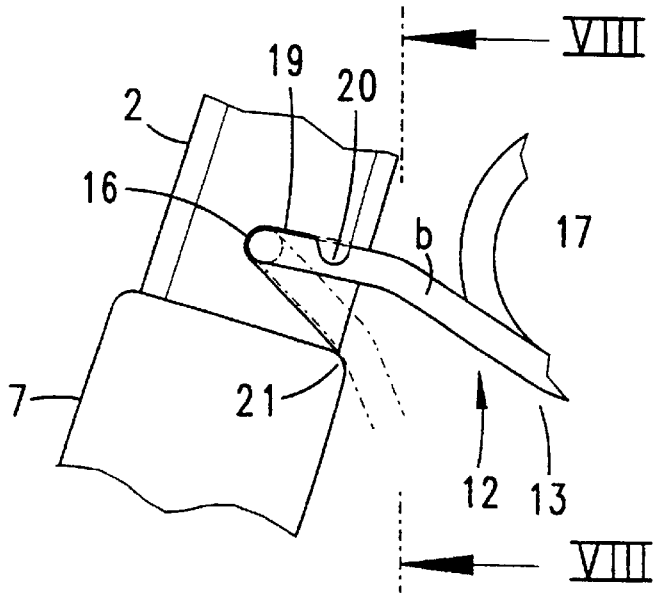
FIG. 7 shows an enlargement of the articulation of the spring.

As can clearly be gathered from FIG. 7, the shorter spring section b can also engage against a stop edge 21 in the vicinity of the border. Further pivoting of this section means resistance and thus an increased spring force of the spring 14.

Figure 9:
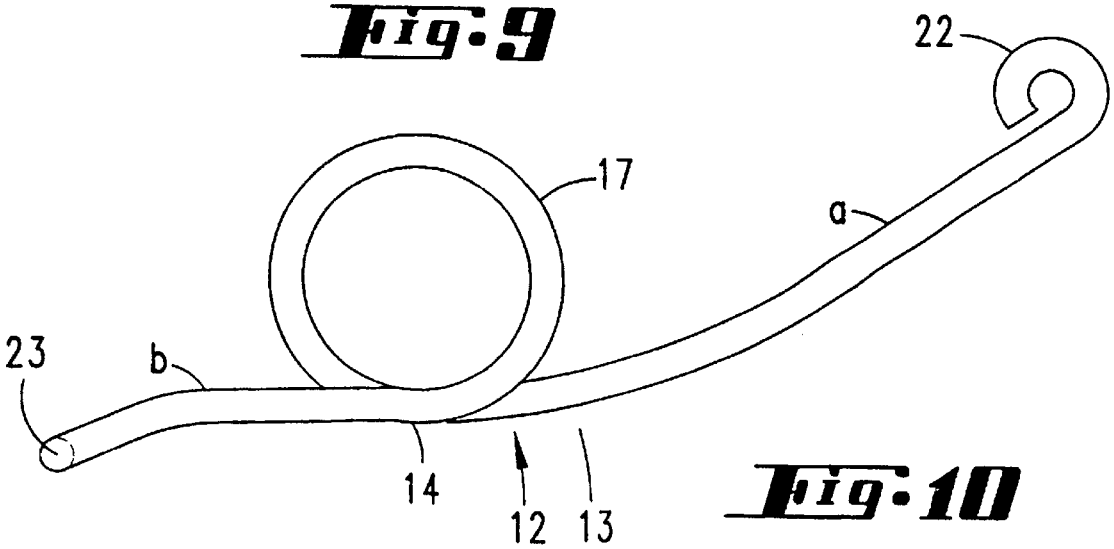
FIG. 9 shows the spring in side view.
Figure 10:
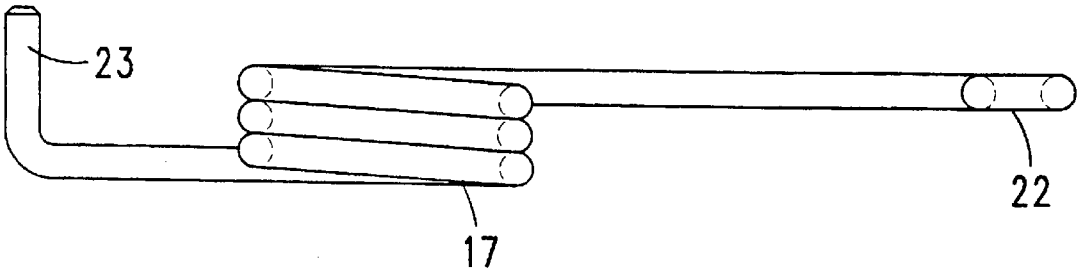
FIG. 10 shows the spring in plan view.

As can be gathered from FIGS. 9 and 10, the spring 14 forms three layers of turns in the region of the spring coil 17. These layers of turns overlap one another on the border side under loading, which aids, i.e. increases, the spring action. The one end forming the longer spring section a is rolled into a bearing eyelet 22 at the end. The other end forms an angled bearing pin 23.

The spring drive 12 of the second exemplary embodiment is basically of the same construction. The reference numerals are transferred analogously, without repetitions in the text. The difference is that the spring 14 forms two spring coils 17. These adjoin one another directly to form, in principle, a figure of eight. The supporting surface, which is also selected in this case in relation to the shorter spring section b, is designated 19. In this case it extends, rather than transversely, in the longitudinal direction of the penetrating pliers leg 2. However, the shorter spring section b is now very much straightened out, whereas, according to the first exemplary embodiment, it exhibits an obtuse-angled bend. This is predetermined and, when striking against the stop edge 21, can become even more pronounced, that is to say can become part of the spring action.

Let us now deal with the pliers 1 according to the third exemplary embodiment. In this case, instead of an integral formation of the spring drive 12, the latter has two parts. In this case too, the reference symbols are used analogously, in some cases without repetitions in the text. In this case, the regulating element 12 comprises a spring section a and a rigid section b'. In relative terms, this shorter spring section forms an element which is for all practical purposes not resilient.

The spring section a is the outer end section of a helical spring 25. This has a gently arcuate, convex profile, as seen from the handle sections 7, 8, and merges into the bearing eyelet 22. The inner end turn of the helical spring 25 is fastened on the rigid section b'. It is secured on a square stub 26. This projects transversely from a link 27. The link 27 may be formed in a pair such that the wound section of the helical spring 25 is concealed, that is to say obtains, in a manner of speaking, a spring chamber.

The square stub 27 is connected firmly to the link or links 27. The other end of the link 27 is articulated rotatably on the penetrating pliers leg 2, in this case also forming the point of articulation 16 explained. This exemplary embodiment also takes the precaution of the shorter section of the spring drive 12, thus in this case of the rigid section b', being supported at a location beyond which it is not possible to pass in the direction of the pliers mouth M, this being realized by the illustrated supporting flank 19 of the pliers leg 2.

The abovedescribed pliers function as follows: by virtue of the pliers legs 2, 3 being closed, the spring drive 12 is brought, counter to the restoring force of the spring 14, into a more pronounced V-position in relation to its legs. The longer spring section a passes into a position in which it runs in virtually the same direction as the pliers leg 3. The pliers jaw 6 runs in the direction of the pliers jaw 5. If an object 18 is then gripped by these jaws, the spring 14 yields in the direction of the handle sections 7, 8. This produces a lever action to the effect that the catch 10 enters into the tooth gaps 11 of the latching toothing formation. The abovedescribed forced rotation of the movable pliers-mouth jaw 6 commences, with a powerful grip being applied in the process. The shorter spring section, be this resilient or rigid, follows this bending-in movement of the spring bridge. By virtue of the pliers being let go, the object 18 is released and the pliers 1 return into their spring-loaded, ready-to-grip open position.

The spring is thus advantageously used such that it also performs the function of an actuating member (regulating element 13). Of course—as indicated—it is also possible for the springs to be realized in the form of a leaf spring, as can also be seen in the fourth embodiment according to FIG. 17. When the mouth M is closed in the empty state, it is essentially just the one, longer spring section a which acts resiliently, utilizing a spring-force reserve stored in the form of coils 17 (see also FIG. 18). The shorter spring section remains, for all practical purposes, in its basic position, predetermined by a supporting flank. If, in contrast, an object is gripped by the mouth M of the pliers 1, pivoting of the shorter spring section b, be this resilient or rigid, takes place in a type of reverse thrust, via the longer spring section a.

Instead of, as illustrated, an essentially V-shaped profile of the spring 14, an S-shaped profile is also conceivable (see FIG. 18), the cross-piece of the S having the spring coil 17. The longer spring section a is aligned as illustrated in the exemplary embodiments, whereas the shorter spring section b has a U-bend 28 in the direction of the articulation pin 4. This spring section is thus somewhat longer and also more resilient. A balanced length ratio is preferably present here, whereas the exemplary embodiments illustrated has a ratio between a:b of approximately 3:1. In all the exemplary embodiments, the coil hollows may be closed by plates or buttons which can be connected in the manner of push buttons.

Figure 19:
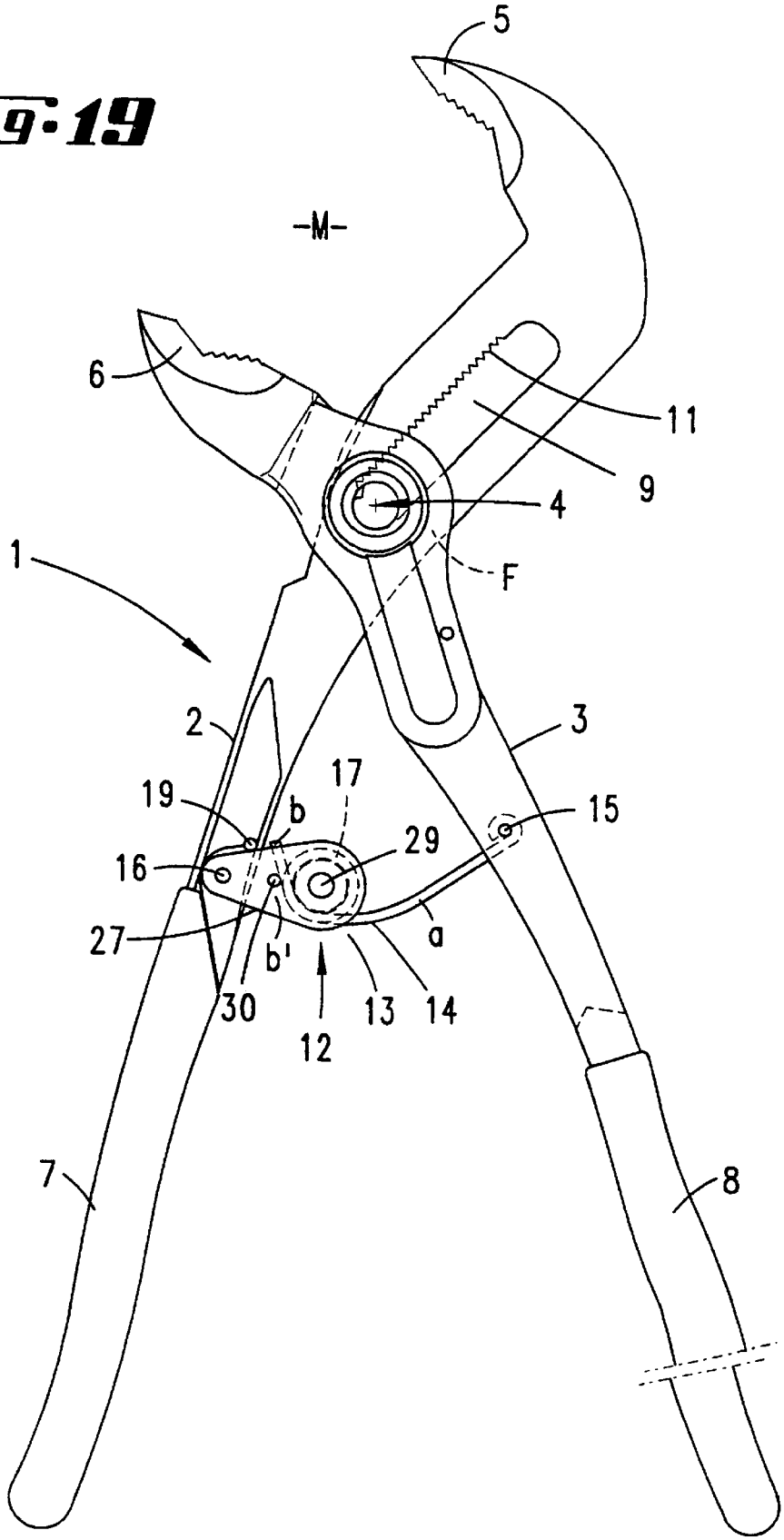
FIG. 19 shows a fifth exemplary embodiment of the pliers in side view, in a spring-loaded, open position.

The fifth exemplary embodiment, illustrated in FIG. 19, of the pliers 1 is similar in structural terms to the pliers according to the third exemplary embodiment, it also being the case here that the regulating element 13 comprises a combination of spring section a and rigid section b'. The rotary stop, also provided here, in the form of a supporting flank 19 ensures that the spring drive 12 swings out in the direction away from the mouth. The reference numerals are used analogously, in some cases without repetitions in the text.

A paired arrangement of the links 27 can be gathered from FIG. 19. These links extend congruently and, in outline, describe substantially a droplet form. The point of articulation 16 to the pliers leg 2 is located in the narrower zone.

Spacing apart the two links 27 from one another allows for a free space in which the spring coil 17 of the spring 14, realized as a rotary leg spring, is accommodated. The group of turns of the spring coil 17 is secured in the resulting spring chamber. The corresponding spring fastening is achieved by a carrying pin 29. This passes through the pair of links 27 and, in the process, penetrates the group of turns of the spring 14. The carrying pin 29 may be dimensioned such that, with account being taken of the capacity for movement of the spring coil 17, a slip-free mount is provided.

As can further be gathered from the drawing of FIG. 19, the spring section b does not continue as far as the point of articulation 16; rather, it is supported within the free space of the pair of links 27. For this purpose, the spring section b engages against a pin 30, which penetrates the free space, forming the spring chamber, at a spacing from the carrying pin 29. The ends of the pins 29 and 30 are fastened in the plate-like parts of the link 27.

Figure 20:
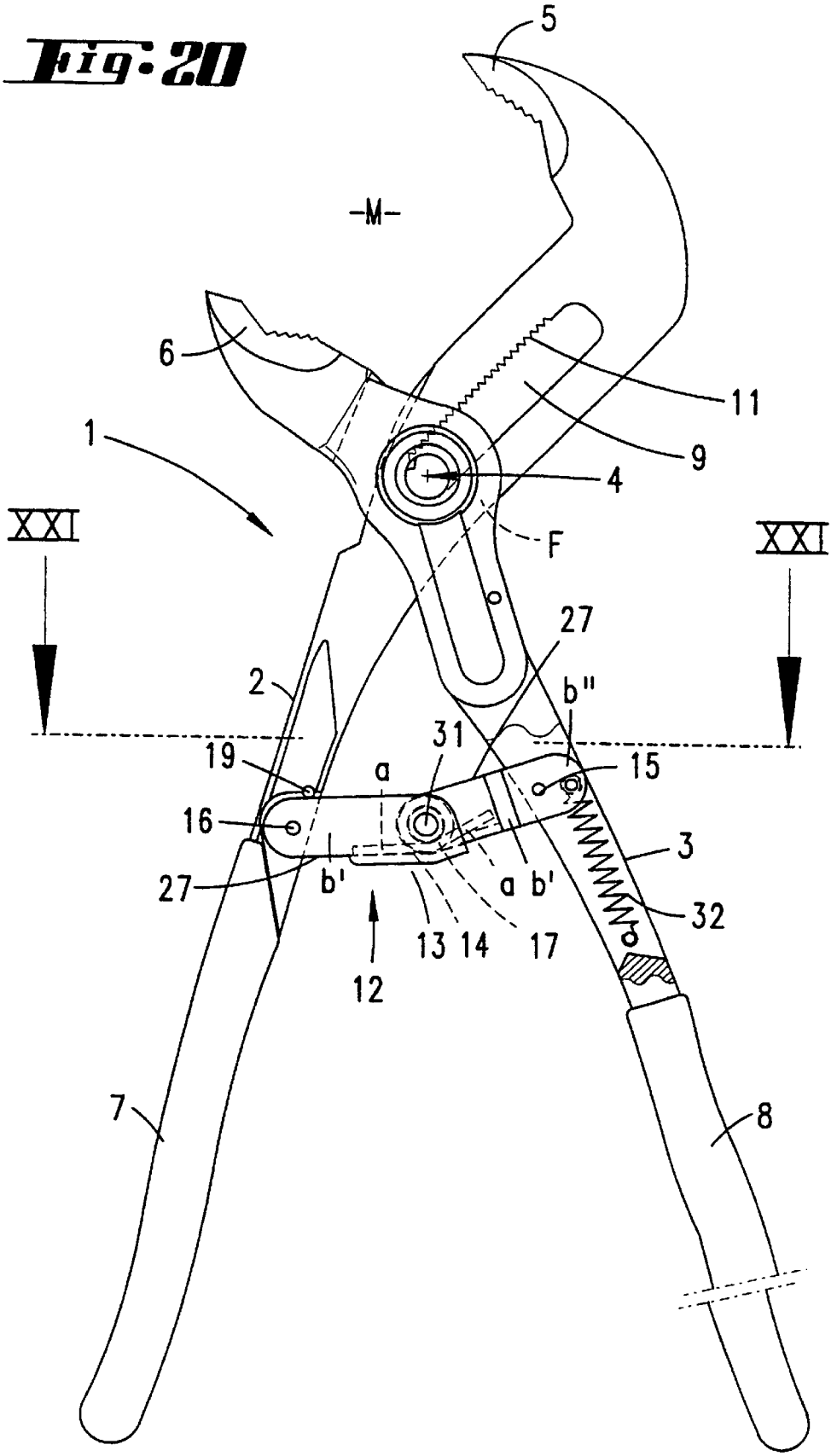
FIG. 20 shows a sixth exemplary embodiment of the pliers in side view, in a spring-loaded, open position.
Figure 21:
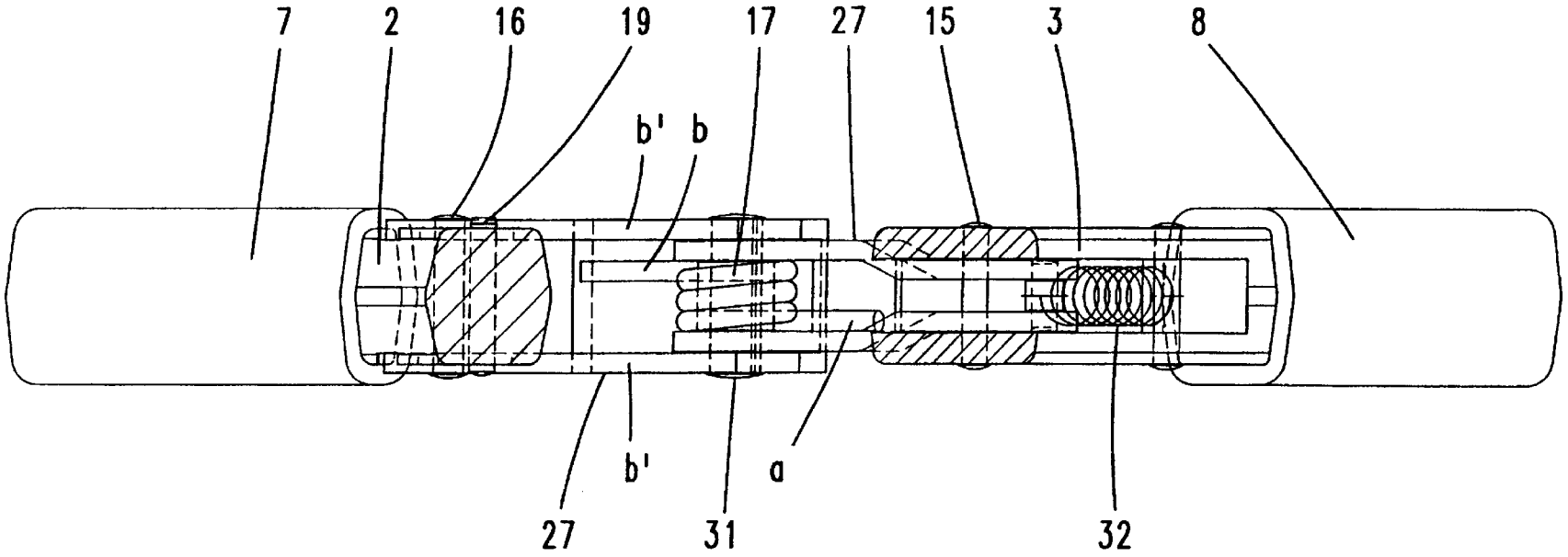
FIG. 21 shows, on an enlarged scale, the section along line XXI—XXI in FIG. 20.

Such a rotary leg spring is also used in the sixth exemplary embodiment. Reference will now be made to FIGS. 20 and 21. This spring 14 is associated with rigid sections b' which are connected to one another in the manner of a toggle joint. The toggle-joint pin here is designated 31. Those ends of the two rigid sections b' which are oriented away from one another are connected in an articulated manner to the pliers legs 2, 3 via points of articulation 15, 16. It is also the case here that the toggle joint bends out in the direction away from the mouth.

The two rigid sections b' are formed by U-profile sections which are nested one inside the other. In the region of the toggle-joint pin 31, stop-forming overlapping of the ends at this location is ensured. This gives a defined straightened-out position of the two rigid sections b', this position being effected by the spring 14. Accordingly, the spring sections, both designated a in this case, subject the rigid sections b' to loading in the direction away from the mouth.

The spring drive 13, which expands the pliers legs 2, 3 or the handle sections 7, 8 thereof, is also assisted here by a further spring 32 which is disposed on the handle section 8. This further spring, accordingly, acts in the same direction as the straightened-out position of the rigid sections b' in relation to one another, the latter sections thus being pre-loaded very well. As far as the straightened-out position is concerned, it should be explained that, in the straightened-out state, the two rigid sections enclose between them an angle of less than 180° which opens on the mouth side. The rigid sections b', which are connected to one another in the manner of toggle joints, can thus only bend out in the direction away from the mouth. The toggle-joint pin 31 cannot pass into a dead-centre position between the points of articulation 15 and 16. It is also the case that all other spring drives 12 can only bend out in the direction away from the mouth, e.g. on account of the correspondingly handle-section-side curved profile or of an angled profile of the rigid section b' and spring section a.

The further spring 32 is connected to a rigid section b" which extends beyond the point of articulation 15. This rigid section b" gives the rigid section b' a double-armed configuration. The spring 32 is a tension spring. Conversely, it would also be possible for the shorter arm of the double-armed rigid section b'/b" to act there as a compression spring. The spring 32 is expediently accommodated in the free space F of the pliers leg 3.

The pliers 1 according to the seventh exemplary embodiment (see, for example, FIG. 22) have, as spring 14, a clip spring B. This has two clip-spring arms 33, 33'. The clip spring B, which forms a sort of closed U, has a clip-spring bend 33" of relatively short form. The clip-spring arms 33, 33' are of different lengths. The one which is designated 33 is the shorter clip-spring arm. The basis for dimensions is the clip-spring bend 33", which is located transversely to the clip-spring arms.

The clip spring B forms the link-like regulating element 13 as well as the spring drive 12. This regulating element is positioned obliquely in relation to a plane of symmetry of the pliers 1. In the seventh exemplary embodiment, the clip-spring bend 33" extends in a position which is more remote from the mouth than the freely projecting ends of the two clip-spring arms 33, 33'. In the exemplary embodiment mentioned, the clip-spring arms 33, 33' are supported on the pliers leg designated 3 so as to form points of articulation. The clip-spring bend 33" is supported on the pliers leg designated 2. In this respect, there are two points of articulation on the pliers leg 3. The point of articulation for the shorter clip-spring arm 33 is designated 15' and that of the longer clip-spring arm 33' is designated 15". The latter point of articulation is closer to the mouth.

The other end of this regulating element 13 is as a clip-spring bend of U-shaped configuration. The clip-spring bend 33" acts as a torsion spring.

The clip-spring bend 33" is supported on the pliers leg 2 and guided in a longitudinally movable manner. It passes through a slot 34 of the pliers leg 2 and is accommodated therein. The slot 34 is of such a length that, when the pliers 1 close, the corresponding yielding movement can be carried out. The corresponding yielding displacement of the regulating element 13 is not illustrated since it is easily conceivable.

Figures 22, 22A, 23:
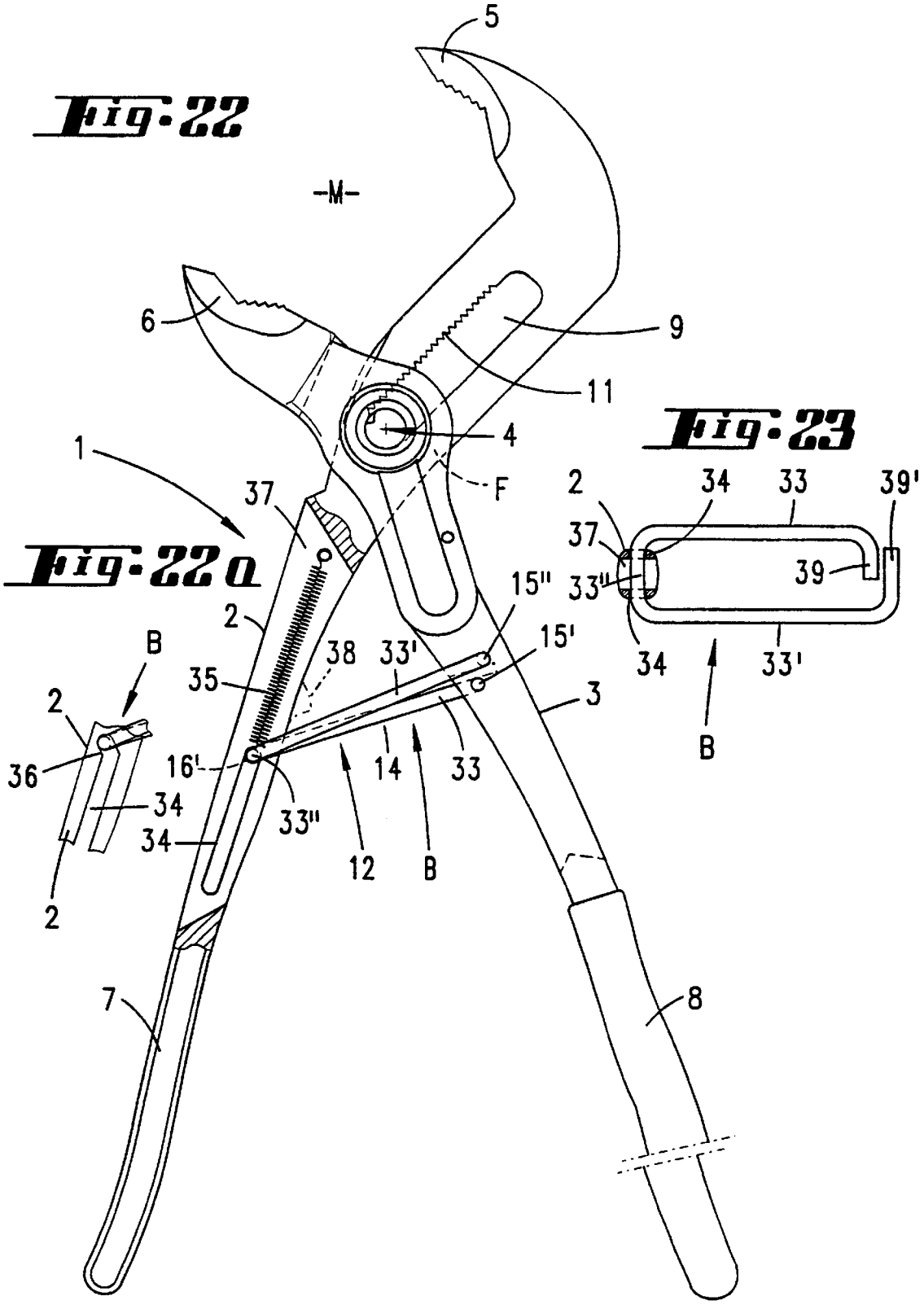
FIG. 22 shows a seventh exemplary embodiment of the pliers in side view, in a spring-loaded, open position.
FIG. 22*a* shows a variant of the support of the spring.
FIG. 23 shows the spring illustrated on its own, showing the guided articulation in the one pliers leg.

By virtue of the handle sections 7, 8 being advanced towards one another, the points of articulation 15', 15" change spatially in relation to one another by the clip-spring arms 33, 33', which according to FIG. 22 are still in an acute-angled expansion position, advancing towards one another. The resulting longitudinal constraint on the shorter clip-spring arm 33 stores further spring force, which is also present already from a certain prestressing. Once the handle sections 7, 8 have been let go, this overall force always results in the open position, which can be seen from FIG. 22, being produced. With the pivoting of the pliers legs 2, 3, the U-clip-spring bend 33", functioning as a displaceable point of articulation 16', is initially still supported.

This can be achieved in two ways. In this respect, FIG. 22 provides a tension spring 35. This, under a certain prestressing, keeps the point of articulation 16', in other words the U-clip-spring bend 33", initially in abutment against the mouth-side end of the slot 34. Accordingly, the catch 10 engages simultaneously or immediately in the tooth gap 11. The object 18 is gripped. This is followed by the necessary displacement of the clip-spring bend 33" as a result of the supporting action of the regulating element 13. The latter yields in the slot 34 in the direction of the end of the handle section 7. In this case, the force of the tension spring 34 is overcome for all practical purposes suddenly.

Another embodiment of a supporting step which can be overcome at will is represented in FIG. 22*a*. The procedure here is such that the U-clip-spring bend 33" is supported via a profiling, in specific terms by an initial supporting surface 36 which is inclined in relation to the longitudinal direction of the pliers leg 2 and grips below the clip-spring bend 33".

In FIG. 22, the tension spring 35 is accommodated in a free space 37 of the pliers leg 2, said free space corresponding approximately to the free space F. Said free space 37 also extends over the entire length of the slot 34. The fastening means for the spring 14 will not otherwise be explained in any more detail.

Alternatively, it is also possible for the clip spring B to be supported merely on the inside of the pliers leg 2, guided on a rail. For this purpose, all that is required is for the clip-spring bend 33" to have a corresponding guide profiling, for example in the form of a W-shaped fold of the wire of the clip spring B. The rail in this case could have a supporting nose 38 which defines the open position according to FIG. 22. Nevertheless, the tension spring 35 would also be used in this version.

The eighth exemplary embodiment is based, according to FIG. 24, once again on a combination of spring section a and rigid section b', in this case formed, again, by a link 27. The reference numerals are used analogously, where necessary for understanding, here too in some cases without repetitions in the text.

However, the clip spring B described in detail in relation to the seventh exemplary embodiment is used here. In this case, however, it is the other way round, to be precise such that the clip-spring arms 33, 33' now acts, or is supported on, a rigid section b' which is mounted rotatably pliers leg, to be precise the pliers leg designated 2. This provides, in a manner of speaking, an indirect support of the spring. It is also the case here that the freely projecting clip-spring arms, 33, 33' are mounted on the self-rotatable rigid section b' such that they can be rotated via different axes of rotation. It may be gathered that clip-spring arms 33, 33' of different length are also provided here. In this case, the shorter clip-spring arm 33 is closer to the mouth M of the pliers 1. In this exemplary embodiment too, the clip-spring arms 33, 33' also pass, with actuation of the pliers 1, into a crossed position, effected by the rigid section b' pivoting about the point of articulation 16, that is to say by the link 27. The link-side axes of rotation are designated 16' and 16" here.

Inwardly angled plug-in pins 39, 39' (see FIG. 23) which form mutually overlapping ends have an axis-forming function in respect of the points of rotation both in the solution according to the seventh exemplary embodiment and in that according to the eighth exemplary embodiment.

Figure 24:
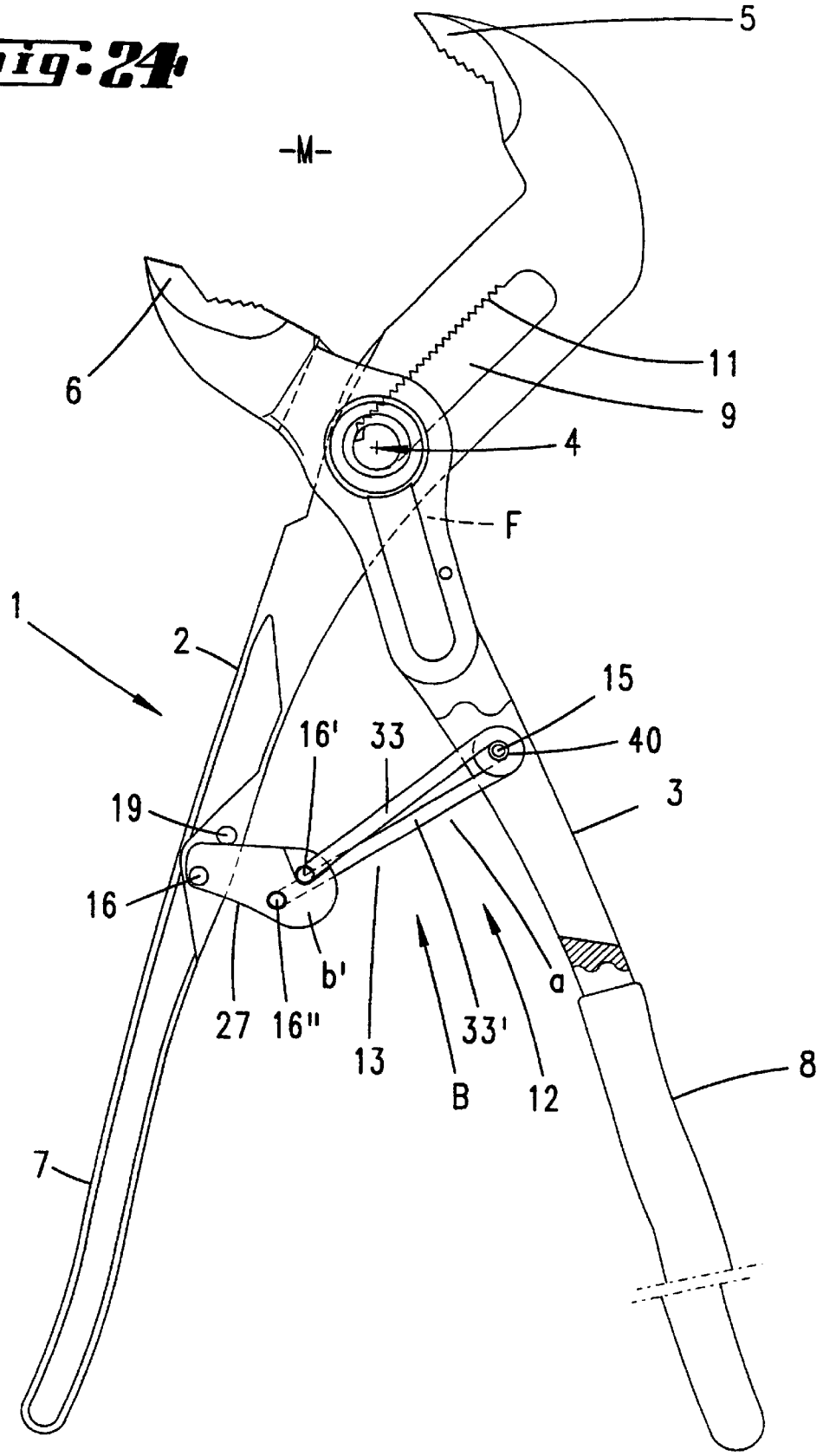
FIG. 24 shows an eighth exemplary embodiment of the pliers in side view, in a spring-loaded, open position.

According to FIG. 24, the clip-spring bend 33" has a helical profile. It is made into a bearing eyelet 40. The hollow of the latter is penetrated by a pin providing the point of articulation 15.

The clip-spring arms 33, 33' may be curved, so that, with the displacement of the axes of rotation 16', 16" taking place by rotation of the link 27, the also force-storing bending-out action of the compressed clip-spring arm proceeds in the correspondingly predetermined direction. In the case of intrinsic prestressing of a clip-spring arm, the straightening-out pull likewise has a spring-force-producing action thereon. A movement counter to the pliers-supported three-point arrangement of the points of articulation reacts as a restoring action, this being accompanied, moreover, by a biassing which keeps the rigid section b' in the basic position on the rotary stop of the pliers leg 2, that is to say on the supporting surface 19. The curvature is concave in the direction facing the pliers mouth M at least on one clip-spring arm.

Figure 25:
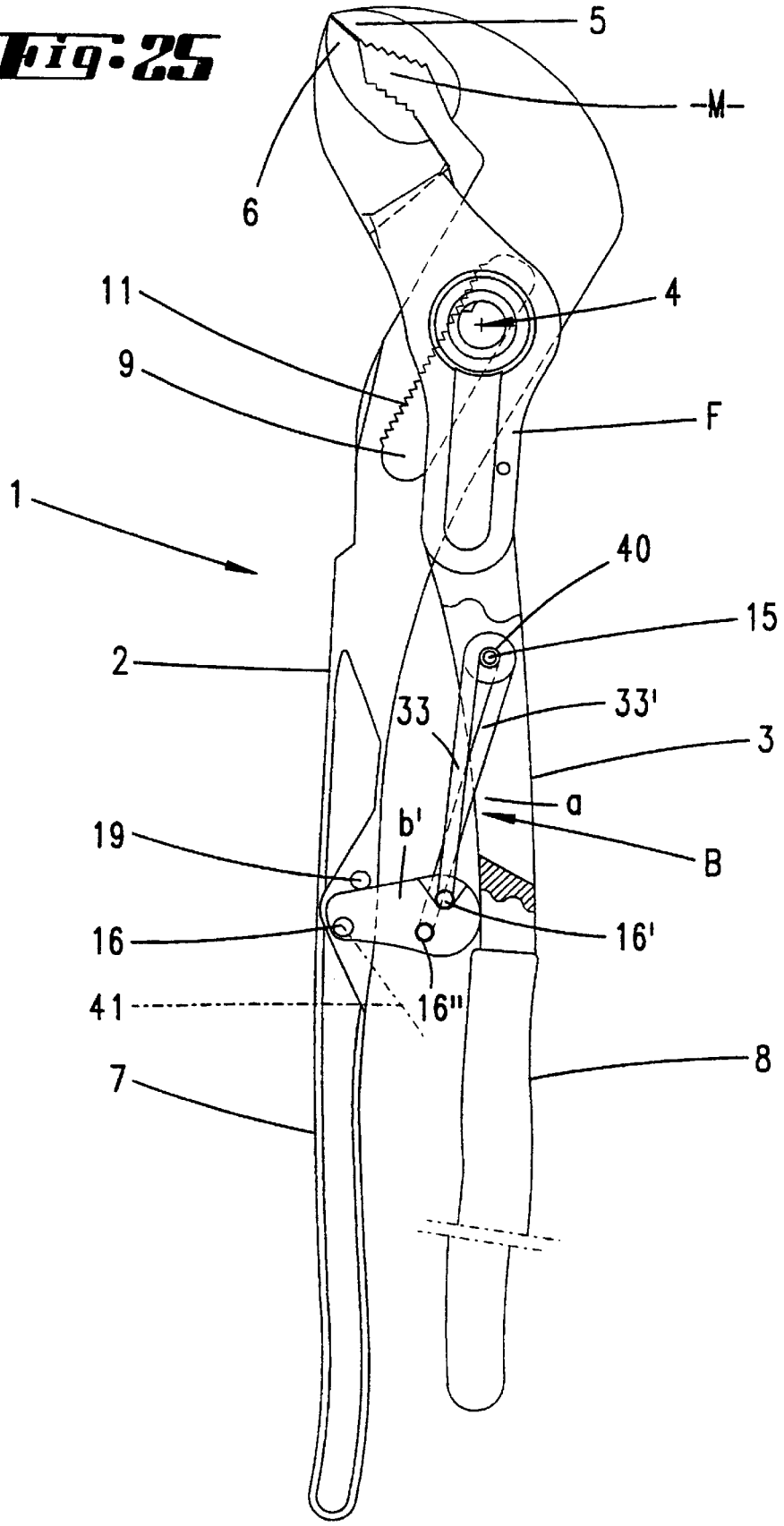
FIG. 25 shows these pliers in side view, in the closed state without an object.
Figure 26:
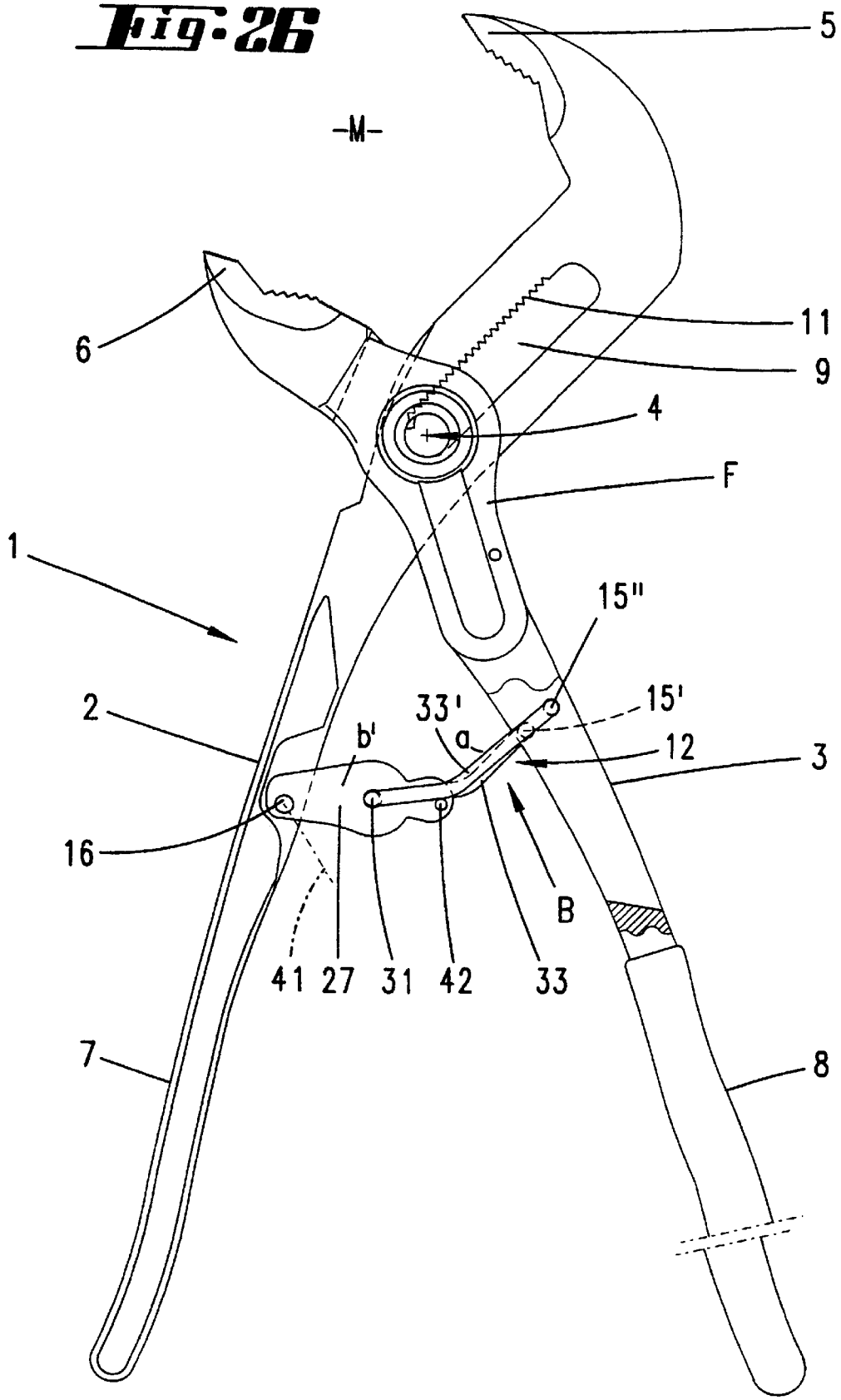
FIG. 26 shows a ninth exemplary embodiment of the pliers in side view, in a spring-loaded, open position.
Figure 27:
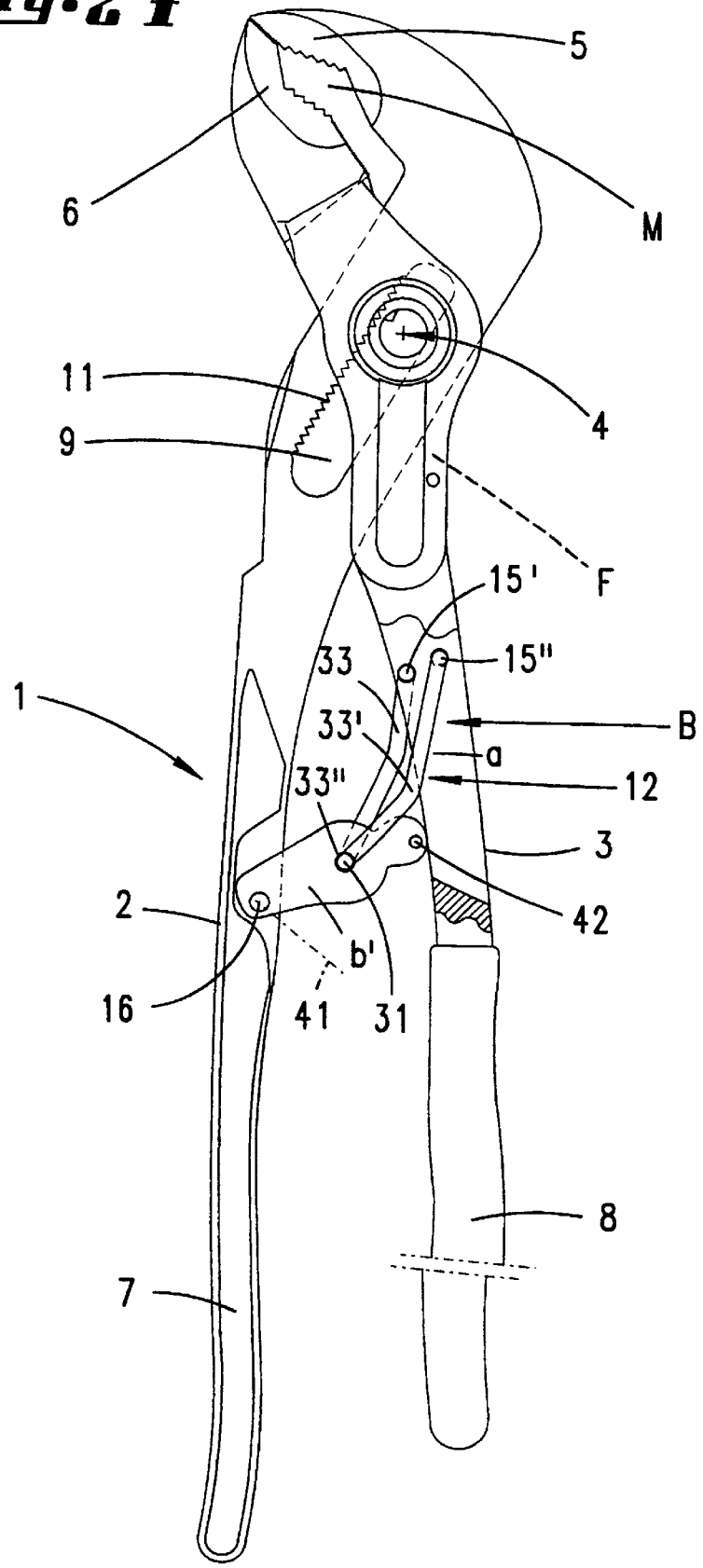
FIG. 27 shows these pliers in side view, in the closed state, without an object.

It can be gathered in relation to FIG. 24 that here too, as in all the other exemplary embodiments, the bending-out movement in the direction away from the mouth takes place. FIG. 25 shows the mouth closed without having accommodated an object therein. It is clear that, with the mouth M filled, the pliers leg designated 3 is displaced further downwards in relation to the mouth, so that the rigid section b' is displaced into the alignment illustrated by chain-dotted lines in FIG. 25. The line is designated 41.

The ninth exemplary embodiment corresponds essentially to the of the eighth exemplary embodiment, but is based, once again, on a toggle-lever-like solution. The manner of articulation of the clip spring B has been taken over from the seventh exemplary embodiment, that is to say the formation of the points of articulation 15', 15" on the pliers leg 3. The procedure here is such that a stop 42 which interacts with the spring 14, that is to say the clip spring B, is formed on the rigid section b'. This stop is seated on the link 27 as a pin which projects beyond the outside of said link, and engages against that side of the clip spring B which is directed away from the mouth M. The clip-spring bend 33" in this case forms the toggle-joint pin 31. With an object 18 being gripped, the toggle-joint-like unit comprising spring drive/regulating element 12/13 bends out in the direction away from the mouth, this unit, here too, having a straightened-out basic position which only allows the bending-out movement to take place in this direction.

We claim:

1. Self-closing pliers (1) which is actuated by one hand, having two pliers legs (2, 3) which are connected to one another by an articulation bolt (4), wherein a pliers mouth (M) is formed above a crossover region of the pliers legs (2, 3) and handle sections (7, 8) are formed on the pliers legs (2, 3) below the crossover region, wherein one of the pliers legs (3), which is adjustable relative to the other pliers leg (2), which is nonadjustable, in the crossover region in order to change the size of the pliers mouth (M), has a free space (F) which is penetrated by the other pliers leg (2), wherein the pliers mouth is formed by a first movable jaw (6) extending from the adjustable pliers leg (3) and a second jaw (5) extending from the non-adjustable pliers leg (2), and wherein, furthermore, the pliers legs (2, 3) are connected via a regulating element (13) comprising a spring drive with a spring (14), which spring biases the pliers mouth (M) into an open position, said open position is produced automatically under spring loading once the handle sections (7, 8) are relieved of loading, wherein, moreover, in a first section of movement of the spring drive (12), the pliers-mouth jaws (5, 6) move towards one another and, in a second movement section, a catch (10) of the articulation bolt (4) engages in a latching toothing formation (11), whereupon forced rotation of the movable pliers-mouth jaw (6) about the articulation bolt (4) is attainable, wherein said spring (14) is supported on the two pliers legs (2, 3), said spring effects expansion of the pliers legs (2, 3) into a spaced-apart position, and said spring effects displacement of the movable pliers leg (3) into a largest open position of the mouth, the expansion and the displacement of the pliers legs being accomplished by said spring with rotation of the adjustable pliers leg (3) by said spring (14), wherein the pliers include a rotary support for the spring (14) located on the adjustable pliers leg (3) on at least one side and on said side, in a non-actuated state, the spring (14) butts against a rotary stop (19) formed on the non-adjustable pliers leg (2), wherein, upon displacement of the movable pliers leg (3) into a workpiece-gripping closed construction of the mouth, the spring (14) is released from the rotary stop only with actuation of force when the pliers-mouth jaws (5, 6) are butting against a workpiece.

2. Pliers according to claim 1, wherein the regulating element (13) is formed by the spring (14) which is supported by two points of articulation respectively on the two pliers legs (2, 3) and, at the same time, biases the pliers mouth (M) into the open position.

3. Pliers according to claim 1, wherein the rotary stop is formed as a supporting flank (19).

4. Pliers according to claim 1, wherein the spring (14), in a form of a leg spring, has two spring sections (a, b) of different spring stiffnesses.

5. Pliers according to claim 4, wherein the different spring stiffnesses are achieved by different lengths of the spring sections (a, b).

6. Pliers according to claim 4, wherein the spring (14) is subdivided into the two spring sections (a, b) by a spring coil (17).

7. Pliers according to claim 2, wherein points for articulation (15, 16) of the spring are disposed at different spacings from the pliers mouth (M).

8. Pliers according to claim 7, wherein one point of articulation (15) of the longer spring section (a) is closer to the pliers mouth (M).

9. Pliers according to claim 4, wherein one of the spring sections is shorter than the other of the two spring sections, and the shorter spring section (b) is supported at a location beyond which is not possible to pass in direction of the pliers mouth (M).

10. Pliers according to claim 7, wherein the spring has two spring sections, one of the spring sections being shorter than the other of the two spring sections, and a capacity for rotary movement of a shorter spring section (b) at the point of articulation (16) is limited in angle.

11. Pliers according to claim 10, wherein an angle of rotary movement is acute.

12. Pliers according to claim 1, wherein the spring (14) has two coils (17) located one beside the other.

13. Self-closing pliers (1) which is actuated by one hand, having two pliers legs (2, 3) which are connected to one another by an articulation bolt (4), wherein a pliers mouth (M) is formed above a crossover region of the pliers legs (2, 3) and handle sections (7, 8) are formed on the pliers legs (2, 3) below the crossover region, wherein one of the pliers legs (3), which is adjustable relative to the other pliers leg (2), which is nonadjustable, in the crossover region in order to change the size of the pliers mouth (M), has a free space (F) which is penetrated by the other pliers leg (2), wherein the pliers mouth is formed by a first movable jaw (6) extending from the adjustable pliers leg (3) and a second jaw (5) extending from the non-adjustable pliers leg (2), and wherein, furthermore, the pliers legs (2, 3) are connected via a regulating element (13) comprising a spring drive (12), which biases the pliers mouth (M) into an open position, which open position is produced automatically under spring loading once the handle sections (7, 8) are relieved of loading, wherein, moreover, in a first movement section of the spring drive (12), pliers-mouth jaws (5, 6) move towards one another and, in a second movement section, a catch (10) of the articulation bolt (4) engages in a latching toothing formation (11), whereupon forced rotation of the movable pliers-mouth jaw (6) about the articulation bolt (4) is attainable, wherein the regulating element (13) further comprises a spring (14) with spring section (a) and a rigid section (b') connecting with the spring and wherein the spring (14) is supported on said rigid section (b') and a second rigid section (b') which connect to one another in the manner of a toggle lever.

14. Pliers according to claim 13, wherein the spring section (a) is formed by a helical spring (25).

15. Pliers according to claim 13, wherein the rigid section (b') is a link (27), at one end of which a spring element is fastened and an other end of which is disposed rotatably on the other pliers leg (2).

16. Pliers according to claim 15, wherein the regulating element comprises a further link (27), there being a second free space for the spring (14), and a spring fastening is located between said link and said further link (27).

17. Pliers according to claim 16, wherein spring fastening comprises a carrying pin which penetrates a group of turns of a spring coil (17) and connects the links (27).

18. Pliers according to claim 13, wherein a second spring section (b) of the spring (14) has the form of a rotary leg spring, said second spring section being directed towards the rigid section (b'), is supported on the rigid section (b').

19. Pliers according to claim 16, wherein a support is formed by a pin (30) which connects the link and the further link (27).

20. Pliers according to claim 13, wherein a further spring (32) which is disposed on the handle section (8) preloads one of the rigid sections (b') in order to produce a straightened-out position of the rigid sections (b')in relation to one another.

21. Pliers according to claim 18, wherein the regulating element further comprises a second rigid section, and wherein an angle in a straightened-out state, the two rigid sections (a, b or a, b' or b") enclose between an angle of less than 180° which opens on a mouth side.

22. Pliers according to claim 20, wherein one of the rigid sections (b') is connected to the further spring (32) and is double-armed (b', b").

23. Self-closing pliers (1) which is actuated by one hand, having two pliers legs (2, 3) which are connected to one another by an articulation bolt (4), wherein a pliers mouth (M) is formed above a crossover region of the pliers legs (2, 3) and handle sections (7, 8) are formed on the pliers legs (2, 3) below the crossover region, wherein one of the pliers legs (3), which is adjustable relative to the other pliers leg (2), which is nonadjustable, in the crossover region in order to change the size of the pliers mouth (M), has a free space (F) which is penetrated by the other pliers leg (2), wherein the pliers mouth is formed by a first movable jaw (6) extending from the adjustable pliers leg (3) and a second jaw (5) extending from the non-adjustable pliers leg (2), and wherein, furthermore, the pliers legs (2, 3) are connected via a regulating element (13) comprising a spring drive (12), which biases the pliers mouth (M) into an open position, which open position is produced automatically under spring loading once the handle sections (7, 8) are relieved of loading, wherein, moreover, in a first movement section of the spring drive (12), pliers-mouth jaws (5, 6) move towards one another and, in a second movement section, a catch (10) of the articulation bolt (4) engages in a latching toothing formation (11), whereupon forced rotation of the movable pliers-mouth jaw (6) about the articulation bolt (4) is attainable, wherein the regulating element (13) further comprises a spring (14) with spring section (a) and a rigid section (b') connecting with the spring; and wherein the rigid section (b') is articulated to a first one of the pliers legs and extends from the first one of the pliers legs towards the second one of the pliers legs, and the spring (14) is formed as a clip spring (B) with clip-spring arms (33, 33') and a clip-spring bend (33") joining the clip-spring arms, the clip-spring arms (33, 33') having ends being spaced apart from each other and supported on either of said rigid section (b') or said second one of the pliers legs, and the clip-spring bend (33") being supported on the other of said rigid section (b') or said second one of the pliers legs.

24. Pliers according to claim 23, wherein the clip-spring arms (33, 33') are supported with said rigid section (b') mounted rotatably on the other pliers leg (2).

25. Pliers according to claim 23, wherein the clip-spring arms (33, 33') are supported rotatably on the rigid section (b') via different axes of rotation (16', 16") the clip-spring arms being freely projecting.

26. Pliers according to claim 23, wherein clip-spring arms (33, 33') are different lengths.

27. Pliers according to claim 23, wherein the clip-spring arms (33, 33') are curved.

28. Pliers according to claim 27, wherein a curvature of the clip-spring arms (33, 33') is concave in direction facing the pliers mouth (M).

29. Pliers according to claim 20, wherein formed on the rigid section (b') is a stop (42) which interacts with the spring (14) when the spring drive (12) is in the straightened out position.

30. Pliers according to claim 23, wherein the clip-spring bend (33") is of U-shaped form.

31. Pliers according to claim 23, wherein the clip-spring bend (33") is of helical form.

32. Pliers according to claim 23, wherein the clip-spring bend (33") is supported in longitudinally movable manner on one of the pliers legs (2 or 3).

33. Pliers according to claim 23, wherein the clip-spring bend (33") is accommodated in a slot (34) of the other pliers leg (2).

34. Pliers according to claim 23, wherein a support of the clip-spring (33") is of profiled form with a supporting surface (36) which is inclined in relation to longitudinal direction of the other pliers leg (2) and grips below the clip-spring bend (33").

35. Pliers according to claim 23, within a tension spring (35) wherein a tension spring (35) acting in longitudinal pliers-leg direction acts on the clip-spring bend (33").

36. Self-closing pliers (1) which is actuated by one hand, having two pliers legs (2, 3) which are connected to one another by an articulation bolt (4), wherein a pliers mouth (M) is formed above a crossover region of the pliers legs (2, 3) and handle sections (7, 8) are formed on the pliers legs (2, 3) below the crossover region, wherein one of the pliers legs (3), is adjustable relative to the other pliers leg (2), which is nonadjustable, in the crossover region in order to change the size of the pliers mouth (M), and the non-adjustable pliers leg is penetrated by the adjustable pliers leg, wherein the pliers mouth is formed by a first movable jaw (6) extending from the adjustable pliers leg (3) and a second jaw (5) extending from the non-adjustable pliers leg (2), and wherein, furthermore, the pliers legs (2, 3) are connected via a regulating element (13) comprising a spring drive with a spring (14), which regulating element biases the pliers mouth (M) into an open position, said open position is produced automatically under spring loading once the handle sections (7, 8) are relieved of loading, wherein, moreover, in a first section of movement of the spring drive (12), pliers-mouth jaws (5, 6) move towards one another and, in a second movement section, a catch (10) of the articulation bolt (4) engages in a latching toothing formation (11), whereupon forced rotation of the movable pliers-mouth jaw (6) about the articulation bolt (4) is attainable, wherein said spring (14) is supported on the two pliers legs (2, 3), said spring effects expansion of the pliers legs (2, 3) into a spaced-apart position, and said spring effects displacement of the movable pliers leg (3) into a largest open position of the mouth, the expansion and the displacement of the pliers legs being accomplished by said spring with rotation of the adjustable pliers leg (3) by said spring (14), wherein the pliers include a rotary support for the spring (14) located on the adjustable pliers leg (3) on at least one side and on said side, in a non-actuated state, the spring (14) butts against a rotary stop (19) formed on the non-adjustable pliers leg (2), wherein, upon displacement of the movable pliers leg (3) into a workpiece-gripping closed construction of the mouth, the spring (14) is released from the rotary stop only with actuation of force when the pliers-mouth jaws (5, 6) are butting against a workpiece.

37. Self-closing pliers (1) which is actuated by one hand, having two pliers legs (2, 3) which are connected to one another by an articulation bolt (4), wherein a pliers mouth (M) is formed above a crossover region of the pliers legs (2, 3) and handle sections (7, 8) are formed on the pliers legs (2, 3) below the crossover region, wherein one of the pliers legs (3), is adjustable relative to the other pliers leg (2), which is nonadjustable, in the crossover region in order to change the size of the pliers mouth (M), and the non-adjustable pliers leg is penetrated by the adjustable pliers leg, wherein the pliers mouth is formed by a first movable jaw (6) extending from the adjustable pliers leg (3) and a second jaw (5) extending from the non-adjustable pliers leg (2), and wherein, furthermore, the pliers legs (2, 3) are connected via a regulating element (13) comprising a spring drive (12) with a spring (14), which spring biases the pliers mouth (M) into an open position, which open position is produced automatically under spring loading once the handle sections (7, 8) are relieved of loading, wherein, moreover, in a first movement section of the spring drive (12), pliers-mouth jaws (5, 6) move towards one another and, in a second movement section, a catch (10) of the articulation bolt (4) engages in a latching toothing formation (11), whereupon forced rotation of the movable pliers-mouth jaw (6) about the articulation bolt (4) is attainable, wherein the spring (14) further comprises a spring section (a) and a rigid section (b'); and wherein the spring (14) has a rigid section (b') articulated to a first one of the pliers legs and extends from the first one of the pliers legs towards the second one of the pliers legs, and the spring (14) is formed as a clip spring (B) with clip-spring arms (33, 33') and a clip-spring bend (33") joining the clip-spring arms, the clip-spring arms (33, 33') having ends being spaced apart from each other and supported on either of said rigid section (b') or said second one of the pliers legs, and the clip-spring bend (33") being supported on the other of said rigid section (b') or said second one of the pliers legs.

38. Pliers according to claim 23, wherein the clip-spring bend (33") is supported with said rigid section (b') mounted rotatably on the other pliers leg.

39. Pliers according to claim 23, wherein the clip-spring arms (33, 33') are supported rotatably on a leg of the pliers by via different axes of rotation (16', 16") , the clip-spring arms being freely projecting.

40. Self-closing pliers (1) which is actuated by one hand, having two pliers legs (2, 3) which are connected to one another by an articulation bolt (4), wherein a pliers mouth (M) is formed above a crossover region of the pliers legs (2, 3) and handle sections (7, 8) are formed on the pliers legs (2, 3) below the crossover region, wherein one of the pliers legs (3), is adjustable relative to the other pliers leg (2), which is nonadjustable, in the crossover region in order to change the size of the pliers mouth (M), and the non-adjustable pliers leg is penetrated by the adjustable pliers leg, wherein the pliers mouth is formed by a first movable jaw (6) extending from the adjustable pliers leg (3) and a second jaw (5) extending from the non-adjustable pliers leg (2), and wherein, furthermore, the pliers legs (2, 3) are connected via a regulating element (13) comprising a spring drive (12) with a spring (14), which regulating element biases the pliers mouth (M) into an open position, which open position is produced automatically under spring loading once the handle sections (7, 8) are relieved of loading, wherein, moreover, in a first movement section of the spring drive (12), the pliers-mouth jaws (5, 6) move towards one another and, in a second movement section, a catch (10) of the articulation bolt (4) engages in a latching toothing formation (11), whereupon forced rotation of the movable pliers-mouth jaw (6) about the articulation bolt (4) is attainable, wherein the spring (14) is supported on a first rigid section (b') and a second rigid section (b') which connect to one another in the manner of a toggle lever, and one of the rigid sections butts against a rotary stop formed on the other pliers leg, wherein upon displacement of the movable pliers leg into a workpiece gripping closed construction of the mouth, this rigid section is released from the rotary stop only with actuation of force when the pliers mouth jaws are butting against a workpiece.

41. Pliers according to claim 40, wherein a further spring (32) which is disposed on the handle section (8) preloads one of the rigid sections (b') in order to produce a straightened-out position of the rigid sections (b') in relation to one another.

42. Pliers according to claim 40, wherein the regulating element further comprises a second rigid section, and wherein an angle in a straightened-out state, the two rigid sections (a, b or a, b' or b') enclose between an angle of less than 180° which opens on a mouth side.

43. Pliers according to claim 40, wherein one of the rigid sections (b') is connected to the further spring (32) and is double-armed (b', b").

44. Self-closing pliers (1) which is actuated by one hand, having two pliers legs (2, 3) which are connected to one another by an articulation bolt (4), wherein a pliers mouth (M) is formed above a crossover region of the pliers legs (2, 3) and handle sections (7, 8) are formed on the pliers legs (2, 3) below the crossover region, wherein one of the pliers legs (3), is adjustable relative to the other pliers leg (2), which is nonadjustable, in the crossover region in order to change the size of the pliers mouth (M), and the non-adjustable pliers leg is penetrated by the adjustable pliers leg, wherein the pliers mouth is formed by a first movable jaw (6) extending from the adjustable pliers leg (3) and a second jaw (5) extending from the non-adjustable pliers leg (2), and wherein, furthermore, the pliers legs (2, 3) are connected via a regulating element (13) comprises a spring drive and a spring (14) which is driven by the spring drive, which regulating element biases the pliers mouth (M) into an open position, said open position is produced automatically under spring loading once the handle sections (7, 8) are relieved of loading, wherein, moreover, in a first section of movement of the spring drive (12), the pliers-mouth jaws (5, 6) move towards one another and, in a second movement section, a catch (10) of the articulation bolt (4) engages in a latching toothing formation (11), whereupon forced rotation of the movable pliers-mouth jaw (6) about the articulation bolt (4) is attainable, wherein the regulating element (13) is formed by the spring (14), which is on two points of articulation supported on the two pliers legs and at the same time biases the pliers mouth into the open position.

45. Pliers according to claim 44, wherein one of said points of articulation for the spring (14) is a rigid section (b') articulated to a first one of the pliers legs and extends from the first one of the pliers legs towards the second one of the pliers legs, and the spring (14) is formed as a clip spring (B) with clip-spring arms (33, 33') and a clip-spring bend (33") joining the clip-spring arms, the clip-spring arms (33, 33') having ends being spaced apart from each other and supported on either of said rigid section (b') or said second one of the pliers legs, and the clip-spring bend (33") being supported on the other of said rigid section (b') or said second one of the pliers legs.

46. Pliers according to claim 45, wherein clip-spring arms (33, 33') are different lengths.

47. Pliers according to claim 45, wherein the clip-spring bend (33") is of U-shaped form.

48. Pliers according to claim 45, wherein the clip-spring bend (33") is supported in longitudinally movable manner on one of the pliers legs (2 or 3).

49. Pliers according to claim 44, wherein one of said points of articulation for the spring (14) is provided by a slot (34) extending along a first one of the pliers legs, and the spring (14) is formed as a clip spring (B) with clip-spring arms (33, 33') and a clip-spring bend (33") joining the clip-spring arms, the clip-spring arms (33, 33') having ends being spaced apart from each other and supported on the second one of the pliers legs, and the clip-spring bend (33") is accommodated in the slot (34) of the first one of the pliers legs.

50. Pliers according to claim 49, wherein a support of the clip-spring bend (33") is a part of the slot (34) and of profiled form with a supporting surface (36) which is inclined in relation to longitudinal direction of the first one of the pliers legs and grips below the clip-spring bend (33").

51. Pliers according to claim 49, wherein a tension spring (35) acting in longitudinal pliers-leg direction acts on the clip-spring bend (33").

* * * * *